US009085004B2

(12) United States Patent
Takebe et al.

(10) Patent No.: US 9,085,004 B2
(45) Date of Patent: Jul. 21, 2015

(54) PAINT SUPPLY SYSTEM AND PAINT SUPPLY METHOD

(75) Inventors: Masashi Takebe, Tochigi (JP); Takayuki Ueki, Tochigi (JP); Naoki Kishimoto, Tochigi (JP); Takashi Wakimoto, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 56 days.

(21) Appl. No.: 13/542,342

(22) Filed: Jul. 5, 2012

(65) Prior Publication Data

US 2013/0011567 A1 Jan. 10, 2013

(30) Foreign Application Priority Data

Jul. 5, 2011 (JP) ..... 2011-149313
Jul. 7, 2011 (JP) ..... 2011-150705
Apr. 27, 2012 (JP) ..... 2012-103246

(51) Int. Cl.
*B05B 12/14* (2006.01)
*B05B 5/16* (2006.01)

(52) U.S. Cl.
CPC ..... *B05B 5/1625* (2013.01); *B05B 5/1633* (2013.01); *B05B 12/1454* (2013.01)

(58) Field of Classification Search
CPC .. B05B 5/1633; B05B 12/1454; B05B 5/1625
See application file for complete search history.

(56) References Cited

U.S. PATENT DOCUMENTS

| | | | | |
|---|---|---|---|---|
| 4,785,760 | A | 11/1988 | Tholome | |
| 5,096,126 | A * | 3/1992 | Giroux et al. | 239/690 |
| 5,549,755 | A * | 8/1996 | Milovich et al. | 118/629 |
| 5,630,552 | A * | 5/1997 | Anfindsen et al. | 239/708 |
| 6,458,424 | B1 | 10/2002 | Yoshida et al. | |
| 2002/0046699 | A1 * | 4/2002 | Congard et al. | 118/323 |
| 2006/0177592 | A1 | 8/2006 | Takebe et al. | |
| 2010/0196616 | A1 * | 8/2010 | Clifford | 427/459 |

FOREIGN PATENT DOCUMENTS

| | | | |
|---|---|---|---|
| JP | 63-175662 | A | 7/1988 |
| JP | 4-87755 | U | 7/1992 |
| JP | 2000-176333 | A | 6/2000 |
| JP | 2004-275977 | A | 10/2004 |

* cited by examiner

*Primary Examiner* — Dah-Wei D Yuan
*Assistant Examiner* — Stephen Kitt
(74) *Attorney, Agent, or Firm* — Rankin, Hill & Clark LLP

(57) ABSTRACT

When paint is supplied from a first cylinder device (16) to an application part (14) and the application part (14) performs an application, next applied paint is fed from a supply valve part (20) to a second cylinder device (18). The first cylinder device (16) and the second cylinder device (18; 93) are connected to each other after the application by the application part (20), and the paint in the second cylinder device (18) is supplied to the first cylinder device (16).

11 Claims, 24 Drawing Sheets

93
98
(5)
(6)
106
105
145
107
96
95
32
102
C
(7)
(8)
(9)
(10)
143
142
147
146
135
134
138
141
132
133
34

97
99
98
163
153
152
143
106
107
135
95
96
145
177
179
181
182
157
175
102
32
(18)
(19)
(20)
(21)
(22)
(23)
(24)

PAINT SUPPLY SYSTEM AND PAINT SUPPLY METHOD

BACKGROUND OF THE INVENTION

1. Field of the Invention

The present invention relates to a paint supply technology for supplying paint to an application part which applies the paint on an object to be coated (hereinafter, referred to as a "coated object").

2. Related Art

When coating a coated object, an application part provided on a leading end of an arm of industrial robot sprays paint on the coated object and the paint thus sprayed is applied on the coated object.

Patent Document 1 (JP-A-63-175662) discloses a system for performing the coating on a coated object by an atomizing application part provided on a leading end of an arm of multi-articulated robot. The arm of the multi-articulated robot is provided with a reservoir (hereinafter, referred to as a "cylinder device") connected to the application part and the paint is supplied from the cylinder device to the application part. When the coating process is completed, the robot makes the cylinder device connected to a paint supply pipe which is provided in a wall of a coating room. In this way, new paint is supplied from the paint supply pipe to the cylinder device.

Patent Document 2 (JP-A-2000-176333) discloses a system in which an application part of a rotary atomizing head type is supported on a leading end of an arm of multi-articulated coating robot to spray paint on a coated object and the paint thus sprayed is applied on the coated object. In this system, a cartridge previously filled with paint is mounted on an application part and the paint is supplied from the cartridge to the application part during application. For this reason, a cartridge exchange device for storing a plurality of cartridges is provided in a coating room.

In the system disclosed in Patent Document 2, paint is supplied by a circulation pressure after the cylinder device is connected to the paint supply pipe. In this case, in order to prevent air from entering the cylinder device, the supply capacity (for example, supply rate) of paint is suppressed low and thus it takes a long time to supply paint.

Meanwhile, in the system disclosed in Patent Document 2, by exchanging the cartridge, paint can be supplied without taking a long time. However, the cartridge exchange device occupying a large space should be provided adjacent to the robot and therefore an increase in size of coating equipment is caused.

Patent Document 3 (JP-U-04-087755) and Patent Document 4 (JP-A-2004-275977) disclose a paint supply system in which a supply valve part (color change valve; hereinafter, referred to as "CCV") for selectively supplying a plurality of is kinds of paint or cleaning fluid (liquid or gas used in cleaning) is provided. In this system, the cleaning of paint previously used (applied) is performed, during the color change of paint.

According to the configuration of Patent Document 3, during the color change of paint, cleaning liquid (or cleaning air) is supplied from a predetermined valve included in the CCV and thus the interior of the paint supply system (electrostatic coating device) is cleaned. Specifically, the cleaning liquid supplied from the valve passes through the interior of the paint coating system in sequence of the CCV, the paint supply pipe, a cylinder (cylindrical body) of a pump and an electrostatic coating machine (application part). In this way, the paint remaining in each component can be cleaned.

Similarly, according to Patent Document 4, during the color change of paint, the cleaning liquid supplied from a cleaning valve cleans the CCV, a pipe line, a cylinder and a pumping path under a driving influence of the CCV (color change valve mechanism).

However, in a configuration for performing the cleaning of the coating device by supplying the cleaning liquid from the supply valve part (CCV) during the color change of paint, as disclosed in Patent Documents 3 and 4, the cleaning is performed in a state where a relatively large amount of unused paint remains in the components (for example, pipes to supply paint) constituting the coating supply system. As a result, a paint loss (paint to be discarded by cleaning) increases and thus a coating cost required for coating of the coated object increases.

SUMMARY OF THE INVENTION

Embodiments of the present invention relates to a paint supply technology capable of realizing a space-saving and supplying paint in a short time to a cylinder device which supplies paint to an application part.

Further, embodiments of the present invention relates to a paint supply technology capable of significantly reducing a loss of paint and thus saving a coating cost when a cleaning operation is executed during a color change of paint.

BRIEF DESCRIPTION OF THE DRAWINGS

FIG. 19(*b*) is a front cross-sectional view schematically illustrating a cylinder device.

DETAILED DESCRIPTION OF THE EMBODIMENTS

A paint supply system and a paint supply method according to each embodiment will be described in detail by referring to the accompanying drawings.

First Embodiment

Figure 1:
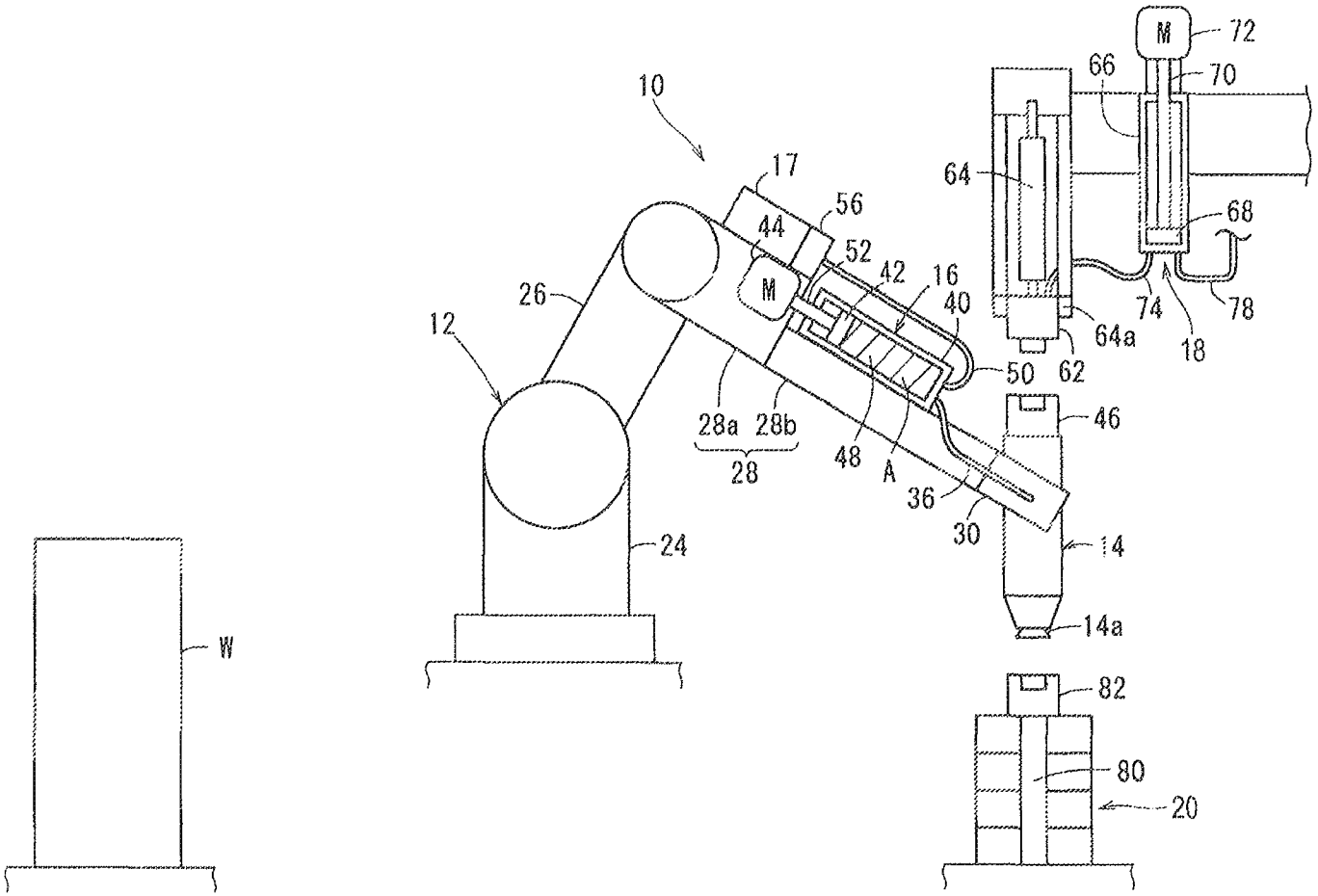
FIG. 1 is a view explaining a configuration of a paint supply system according to a first embodiment.

FIG. 1 is a view explaining a configuration of a paint supply system 10 according to a first embodiment. A coating robot 12 is provided in a coating chamber. A coating gun 14 for spraying paint on a work-piece W as an object to be coated (hereinafter, referred to "coated object") is supported on the coating robot 12. The paint supply system 10 is connected to the coating gun 14.

The paint supply system 10 includes a main cylinder 16 as a first cylinder device, a sub-cylinder 18 as a second cylinder device disposed adjacent to the coating robot 12 and a supply valve part 20 (color change valve; hereinafter, referred to as "CCV") disposed below the sub-cylinder 18. The main cylinder 16 is connected to the coating gun 14 and supplies paint stored therein to the coating gun 14. During application of paint by the coating gun 14, the sub-cylinder 18 temporarily stores paint to be applied next (hereinafter, referred to as "next applied paint") in a state of being disconnected from the main cylinder 16. Further, after application of paint by the coating gun 14, the sub-cylinder 18 is connected to the main cylinder 16 and supplies the next applied paint to the main cylinder 16. During application of paint by the coating gun 14, the CCV 20 is connected to the sub-cylinder 18 to selectively supply paint or cleaning fluid to the sub-cylinder 18. In addition to supplying paint, the CCV 20 also supplies cleaning fluid, which will be describe later.

That is, the paint supply system 10 includes two cylinders of the main cylinder 16 and the sub-cylinder 18. Each of the cylinders 16, 18 is operated to temporarily store paint and discharge the paint stored therein.

In addition, the paint supply system 10 includes a cleaning part 17 connected to the main cylinder 16 and supplying the cleaning fluid to the main cylinder 16 after application of paint by the coating gun 14, independently of connection path with the main cylinder 16 and the sub-cylinder 18.

Figure 2:
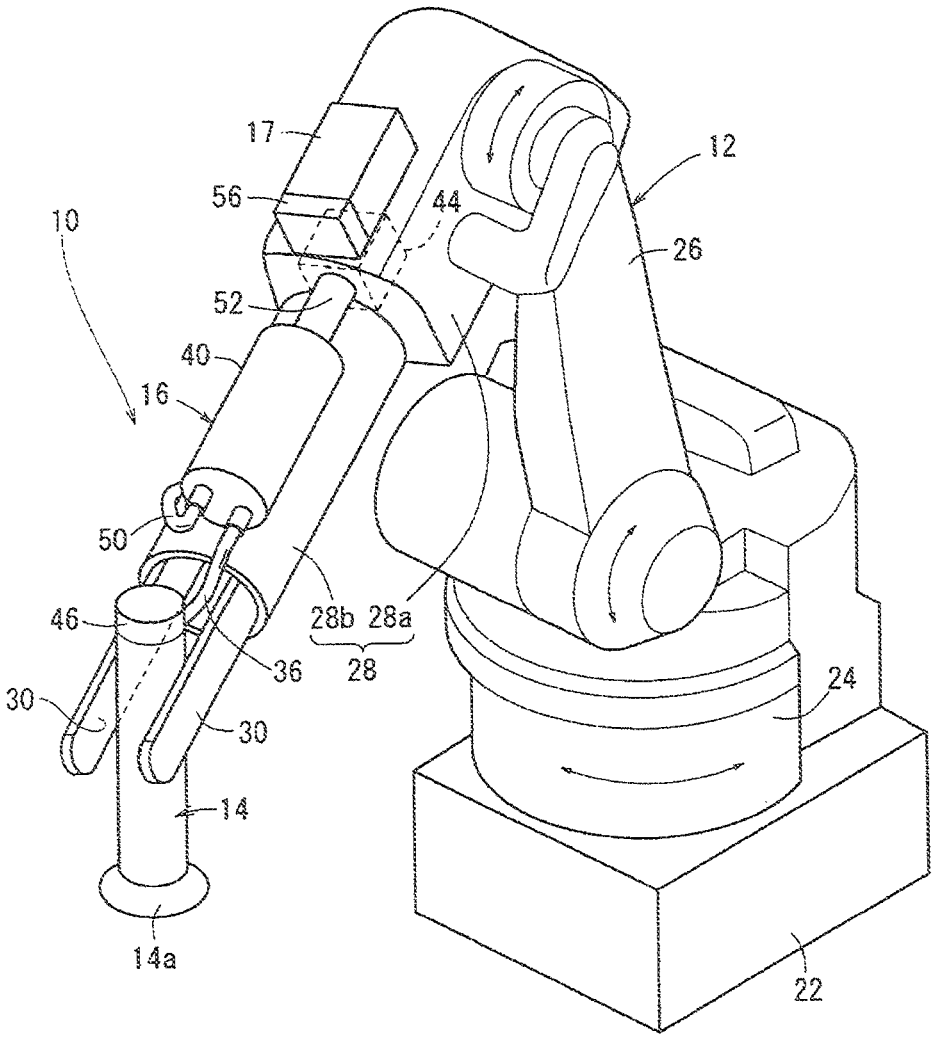
FIG. 2 is a perspective view illustrating a coating robot including the paint supply system.

FIG. 2 is a perspective view illustrating the coating robot 12 including the paint supply system 10. The coating robot 12 is an industrial multi-articulated robot, for example. A turning part 24 of the coating robot 12 is provided on a base 22 fixed to a predetermined position in a coating room and can turn around a vertical axis. A base end of a first arm 26 is connected to an upper portion of the turning part 24 and can turn in a vertical direction. Further, a second arm 28 is connected to a leading end of the first arm 26 and can turn in a vertical direction.

The second arm 28 includes a connection part 28*a* of a base end side connected to the first arm 26 and a cylindrical extension part 28*b* provided continuously with a leading end side of the connection part 28*a* and extending in a direction of the leading end by a predetermined length. The main cylinder 16 is placed on an outer peripheral surface of the extension part 28*b*. Further, a pair of sandwiched plates 30 extends from a leading end of the extension part 28*b* and is placed to turn around an axis of the second arm 28. The coating gun 14 is supported on the pair of sandwich plates 30 and can be swung with the supported point as a pivot point. The coating robot 12 is not limited to such a configuration, but various devices and mechanism can be employed to move the coating gun 14 relative to a work-piece (reference numeral W in FIG. 1).

As the coating gun 14, a known rotary atomizing coating device for electrostatically coating the work-piece can be suitably employed, for example. A rotary atomizing head 14*a* is provided in a leading end of the rotary atomizing coating gun 14. When paint is applied on the work-piece, the rotary atomizing head 14*a* is rotated in a state where a high voltage is applied and thus paint is supplied to the rotary atomizing head 14*a*. Thereby, paint is negatively charged and atomized. The atomized paint is sprayed from the rotary atomizing head 14*a*. The sprayed paint is applied on the work-piece which is grounded. In this way, a good coating operation can be carried out. Of course, the coating gun 14 is not limited to the rotary atomizing coating device for electrostatically coating.

When a coating operation of the work-piece is carried out, a control part (reference numeral 32 in FIG. 3) controls the actuation of a plurality of articulated portions (the turning part 24, the base end of the first arm 26, the base end of the second arm 28 and a pair of sandwich plates 30) of the coating robot 12 to move the coating gun 14 relative to the work-piece. In this way, the rotary atomizing head 14*a* of the coating gun 14 is placed to face a predetermined area of the work-piece. That is, paint is sprayed from the coating-gun 14 in a state of being positioned over the predetermined area of the work-piece by the coating robot 12, thereby coating the work-piece.

Figure 3:
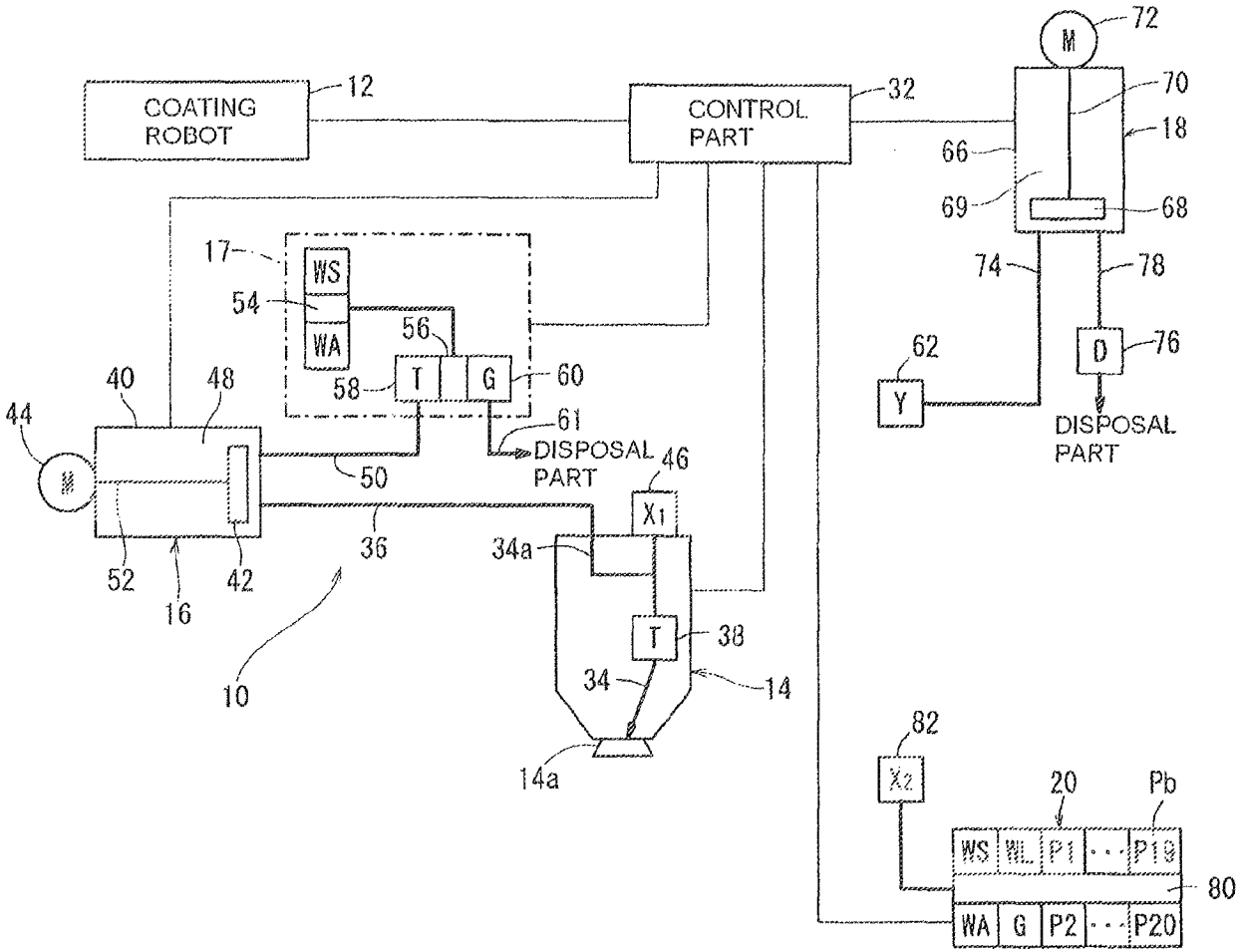
FIG. 3 is a block diagram illustrating a connection relationship between the components of the paint supply system.

FIG. 3 is a block diagram illustrating a connection relationship between the components of the paint supply system 10. A gun's inner paint path 34 through which paint passes is formed inside of the coating gun 14 to extend from a first connection part 46 to the rotary atomizing head 14*a*. Further, a branch path 34*a* is branched from the gun's inner paint path 34 in the coating gun 14. The branch path 34*a* is communicated with a main supply pipe 36 which is connected to the main cylinder 16.

Further, a first trigger valve 38 for opening/closing the gun's inner paint path 34 based on the control of the control part 32 is provided in the gun's inner paint path 34. The first trigger valve 38 is placed at a position downstream from the branch path 34*a*. When paint is applied from the coating gun 14, the first trigger valve 38 is opened to supply paint stored in the main cylinder 16. In this way, the paint is directed to the rotary atomizing head 14*a* of the coating gun 14 and sprayed from the rotary atomizing head 14*a*.

In addition, the first connection part 46 which is connected to the sub-cylinder 18 side is connected to the main cylinder 16. Further, a second connection part 62 which is connected to the first connection part 46 is connected to the sub-cylinder 18.

As the second connection part 62 is engaged with the first connection part 46, the sub-cylinder 18 is connected to the main cylinder 16 via the coating gun 14. That is, a connection path is formed in the sub-cylinder 18 and the main cylinder 16. The connection path is composed of a sub-supply pipe 74, the second connection part 62, the first connection part 46, the gun's inner paint path 34 and the main supply pipe 36.

By referring to FIG. 1, the first connection part 46 is placed on a rear end of the coating gun 14 to communicate with the gun's inner paint path (reference numeral 34 in FIG. 3) and a first connection valve is provided in the first connection part 46. The first connection part 46 is moved to a predetermined position by the coating robot 12 and connected to the second connection part 62. Accordingly, a connecting surface of the first connection part 46 is formed into a concave shape which is engageable with a connecting surface of the second connection part 62. Further, the first connection valve is in a closed state (normally closed) when the second connection part 62 is not connected to the first connection part 46. And, the first connection valve is switched to an opened state based on a command from the control part 32 when the second connection part 62 is connected to the first connection part 46. The first connection part 46 may be configured that the opening/closing of the first connection valve is automatically switched by the connection and disconnection with the second connection part 62.

The second connection part 62 is mounted on a movable part 64*a* of an actuator 64. As the actuator 61 is driven, the movable part 64*a* moves in a vertical direction and thus the second connection part 62 also moves in the vertical direction. Further, the connecting surface of the second connection part 62 is formed with a convex shape which is engageable with the first connection part 46 of the coating gun 14 and a second connection valve is provided in the second connection part. The second connection valve is opened and closed based on a command from the control part (reference numeral 32 in FIG. 3). The second connection valve 62 is connected to a leading end of a cylindrical body 66 of the sub-cylinder 18 via the sub-supply pipe 74.

The CCV 20 (will be described in detail later) is placed in a vertically downward position of the second connection part 62. The CCV 20 includes a third connection part 82 which is connected to the second connection part 62. The second connection part 62 is moved in the vertical direction by the actuator 64 and is connected to the sub-cylinder 18. As the second connection part 62 is moved downward by the actuator 64, the second connection part 62 is connected to the third connection part 82 of the CCV 20. That is, the second connection part 62 is placed to freely advance and retract relative to the third connection part 82.

In addition, the third connection part 82 is provided continuously with an upper portion of a CCV space 80 and a third connection valve is provided in the third connection part. The third connection part 82 is placed in a vertically downward position of the second connection part 62. As the third connection part 82 is moved downwards toward the second connection part 62, the third connection part is connected to the second connection part 62. In this way, the second connection part 62 is connected to the third connection part 82 by advancing toward the third connection part 82. Accordingly, since it is possible to employ a simple actuator 64 in which the moveable part 64*a* is moved in the vertical direction, installation cost can be reduced.

Further, it is desirable that a mechanism similar to the first connection part 46 is applied to the third connection part 82. Thereby, the first connection part 46 and the third connection part 82 can be manufactured by same manufacturing process and thus installation cost can be further reduced. A connecting surface of the third connection part 82 is formed into a concave shape which is engageable with the second connection part 62. The third connection valve is in a closed state when the second connection part 62 is not connected to the third connection part 82. And, the third connection valve is switched to an opened state based on a command from the control part 32 when the second connection part 62 is connected to the third connection part 82.

Connection of the second connection part 62 and the first connection part 46 or the third connection part 82 are summarized as follows. As illustrated in FIG. 3, as the second connection part 62 is moved downward in a state where the coating gun 14 is moved to a predetermined position (a position of vertically downward of the second connection part 62 and also upward of the CCV 20) by the coating robot (reference numeral 12 in FIG. 1), the second connection part 62 can be connected to the first connection part 46. Meanwhile, as the second connection part 62 is moved downward during application of paint by the coating gun 14, the second connection part 62 can be connected to the third connection part 82 of the CCV 20.

As illustrated in FIG. 1, the main cylinder 16 is arranged adjacent to a base end side of the coating gun 14 and has a function to supply paint stored therein to the coating gun 14. The main cylinder 16 includes a cylindrical body 40 attached to the extension part 28*b* of the second arm 28, a piston 42 slidably accommodated in the interior of the cylindrical body 40, a piston rod 52 inserted into a rear end of the cylindrical body 40 and supporting the piston 42 by a leading end thereof, a drive motor 44 for main cylinder connected to a rear end of the piston rod 52 to displace the piston rod 52 in a front and rear direction and supported on the connection part 28*a* of the second arm 28, and the first connection part 46 disposed on a rear end of the coating gun 14.

The piston 42 is formed in an outer diameter to allow a sliding movement along the interior of the cylindrical body 40 in a liquid-tight manner. Accordingly, a paint storing reservoir 48 is formed in the interior of the cylindrical body 40 and defined by an inner wall of the cylindrical body 40 and a leading end surface of the piston 42. In this case, the volume of the reservoir 48 is variable in accordance with the sliding movement of the piston 42 in a front and rear direction.

Further, the main supply pipe 36 connected to the coating gun 14 and a cleaning pipe 50 connected to the cleaning part 17 are attached to a leading end of the cylindrical body 40. The main supply pipe 36 is communicated with the branch path 34*a* (see, FIG. 4) of the gun's inner paint path 34 which is provided in the coating gun 14. The paint can flow from the reservoir 48 of the cylindrical body 40 toward the coating gun 14 through the main supply pipe.

The drive motor 44 for main cylinder includes an internal mechanism which converts a rotational driving force of the motor into a linear motion in an advance-and-retract direction. The drive motor 44 for main cylinder is connected to the control part (reference numeral 32 in FIG. 3). As the control part transmits a command to the drive motor 44 for main cylinder, the piston rod 52 moves in a front and rear direction and thus the piston 42 attached to the piston rod 52 advances and retracts. The drive motor 44 for main cylinder is not particularly limited. For example, a servo motor capable of moving the piston 42 with high-precision may be utilized. Of course, as a driving source other than the drive motor, an air cylinder or a linear actuator may be utilized.

Further, the cleaning part 17 is connected to the main cylinder 16 via the cleaning pipe 50 and configured to clean the paint (hereinafter, referred to as a "residual paint") remaining in the main cylinder 16. The cleaning part 17 supplies the cleaning fluid to the reservoir 48 of the cylindrical body 40 to perform cleaning of the residual paint. As the cleaning fluid used in the present embodiment, there are a liquid (hereinafter, referred to as "cleaning liquid") which is mixed with paint to clean the interior of the cylinder, a water (hereinafter, referred to as "cleaning water") for diluting the paint, and air (hereinafter, referred to as "cleaning air") for blowing out the paint, the cleaning liquid and the cleaning water. These can be suitably selected to perform cleaning.

As illustrated in FIG. 3, the cleaning part 17 includes two cleaning supply valves WS, WA capable of supplying the cleaning water and the cleaning air out of the cleaning fluid, a cleaning fluid space 54 constituting an inlet path and an outlet path of the cleaning fluid and a composite valve 56 for controlling the flow of the cleaning fluid. The two cleaning supply valves WS, WA are opened and closed in a predetermined timing based on a command from the control part 32. In this way, it is possible to provide the cleaning water or the cleaning air to the cleaning fluid space 54.

Further, a second trigger valve 58 and a gate valve 60 are arranged in parallel in the composite valve 56. The second trigger valve 58 is connected to the main cylinder 16 via the cleaning pipe 50 and the gate valve 60 is connected to a disposal part via a cleaning part disposal pipe 61. When the cleaning fluid is supplied to the main cylinder 16, the second trigger valve 58 is opened and the gate valve 60 is closed so that the cleaning fluid space 54 and the reservoir 48 are communicated with each other. In this way, the cleaning fluid can be directed to the main cylinder 16.

Meanwhile, during application of paint by the coating gun 14, the sub-cylinder 18 is disconnected from the main cylinder 16 and temporarily stores paint supplied from the CCV 20. The paint temporarily stored in the sub-cylinder 18 is supplied to the main cylinder 16 in a predetermined timing. As illustrated in FIG. 1, the sub-cylinder 18 is disposed at an opposite position (a position opposite to a coating site) of the work-piece W relative to the coating robot 12 in the coating room. Although the placement position of the sub-cylinder 18 is not particularly limited, it is preferable that the sub-cylinder is arranged in the vicinity of the coating robot 12. By arranging the sub-cylinder 18 in the vicinity of the coating robot 12, the movement quantity and time of the coating gun 14 are reduced. Accordingly, it is possible to improve efficiency of a coating operation.

The actuator 64 for moving the second connection part 62 is disposed in the vicinity of the sub-cylinder 18. The configuration of the sub-cylinder 18 is identical to that of the main cylinder 16. Specifically, the sub-cylinder 18 includes a cylindrical body 66 and a piston 68. The piston 68 is connected to a drive motor 72 for sub-cylinder via a piston rod 70. Further, a mechanism similar to the drive motor 44 for main cylinder is also applied to the drive motor 72 for sub-cylinder.

Further, as illustrated in FIG. 3, a sub-disposal pipe 78 as well as the sub-supply pipe 74 is connected to a leading end of the cylindrical body 66. A dump valve 76 is provided in the middle of the sub-disposal pipe 78. The sub-disposal pipe 78 extends to the disposal part.

The CCV 20 includes a plurality of supply valves Pb for supplying the paint, the CCV space 80 into which the paint and the cleaning fluid supplied from the supply valves Pb flow, and the third connection part 82 provided on an upper portion of the CCV space 80. The paint and the cleaning fluid supplied to the sub-cylinder 18 can pass through the third connection part 82. A plurality of kinds of paint can be supplied to the CCV 20. As the plurality of kinds of paint, a pigment (color), a solvent, or an additive, etc., can be suitably prepared, depending on the work-piece (reference numeral W in FIG. 1) to be coated. Selected paint or cleaning fluid is introduced from the plurality of supply valves Pb disposed in multiple supply pipes into the CCV space 80. That is, the CCV 20 is configured as a so-called manifold.

Specifically, twenty supply valves Pb (P1 to P20 in the drawings) are provided for supplying the paint and one supply valve Pb (WS, WA, WL in the drawings) is respectively provided for supplying the cleaning water, the cleaning air and the cleaning liquid as the cleaning fluid. The plurality of supply valves Pb are opened and closed independently of each other based on a command from the control part 32. In this way, it is possible to allow a predetermined paint or cleaning fluid to flow into the CCV space 80. Of course, the number of the supply valves Pb is not limited to such a value.

The control part 32 is connected to the coating robot 12, the coating gun 14, the main cylinder 16, the sub-cylinder 18 and the CCV 20 to control each of these components. A known computer can be employed as the control part 32. A control program for controlling each component in accordance with a predetermined sequence (paint supply method) is stored in the control part 32.

The paint supply system 10 is basically configured as described above and an operation of the paint supply system 10 will be described.

In the paint supply system 10, during application of paint by the coating gun 14 (i.e., while the main cylinder 16 supplies paint to the coating gun 14), next applied paint is supplied to the sub-cylinder 18. Then, after application of paint by the coating gun 14, the sub-cylinder 18 is connected to the main cylinder 16 to supply the paint filled in the sub-cylinder 18 to the main cylinder 16. In this way, it is possible to improve the paint supply capacity (for example, paint supply rate).

Figure 4:
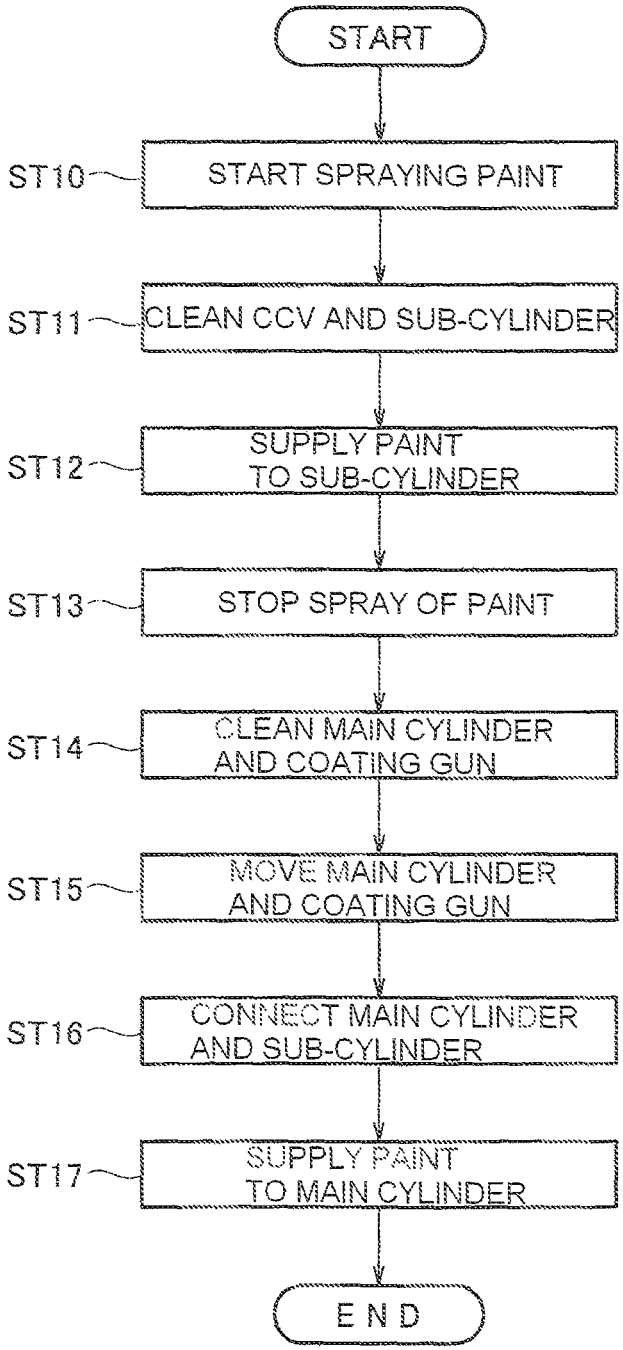
FIG. 4 is a flowchart illustrating a paint supply method.

FIG. 4 is a flowchart illustrating a paint supply method. Hereinafter, a flow of an operation when first applying paint A and next applied paint B are different from each other (i.e., when carrying out the color change of paint) will be described.

First, paint A previously filled in the main cylinder 16 is supplied to the coating gun 14 and then sprayed from the coating gun 14 toward the work-piece (W) (STEP (hereinafter, referred to as "ST") 10: application process).

Next, the sub-cylinder 18 and the CCV 20 are connected to each other, in a state where the sub-cylinder 18 is disconnected from the main cylinder 16. Cleaning fluid is supplied from the CCV 20 to clean the sub-cylinder 18 and the CCV 20 (ST11: cleaning process for primary supply side).

Next, the next applied paint B is supplied from the CCV 20 to the sub-cylinder 18 (ST12: primary supply process).

Next, the spray of the paint A from the coating gun 14 is stopped (ST13: application process).

Next, cleaning fluid is supplied from the cleaning part 17 to the main cylinder 16 and the coating gun 14 to clean the main cylinder 16 and the coating gun 14 (ST14: cleaning process for application side). In this cleaning process, discharging of the residual paint A remaining in the main cylinder 16 is also performed.

Next, in order to supply the next applied paint B from the sub-cylinder 18 to the main cylinder 16, the coating gun 14 and the main cylinder 16 are moved to a predetermined position by the coating robot 12 (ST15: main cylinder moving process).

Next, the main cylinder 16 and the sub-cylinder 18 are connected to each other (ST16: connection process).

Next, the paint B is supplied from the sub-cylinder 18 to the main cylinder 16 (ST17: secondary supply process).

As the paint B is supplied to the main cylinder 16, the paint B is sprayed by the coating gun 14. Of course, the ST11 and ST14 can be omitted when the color change of paint is not carried out. Hereinafter, specific operation of each step will be described.

Figure 5:
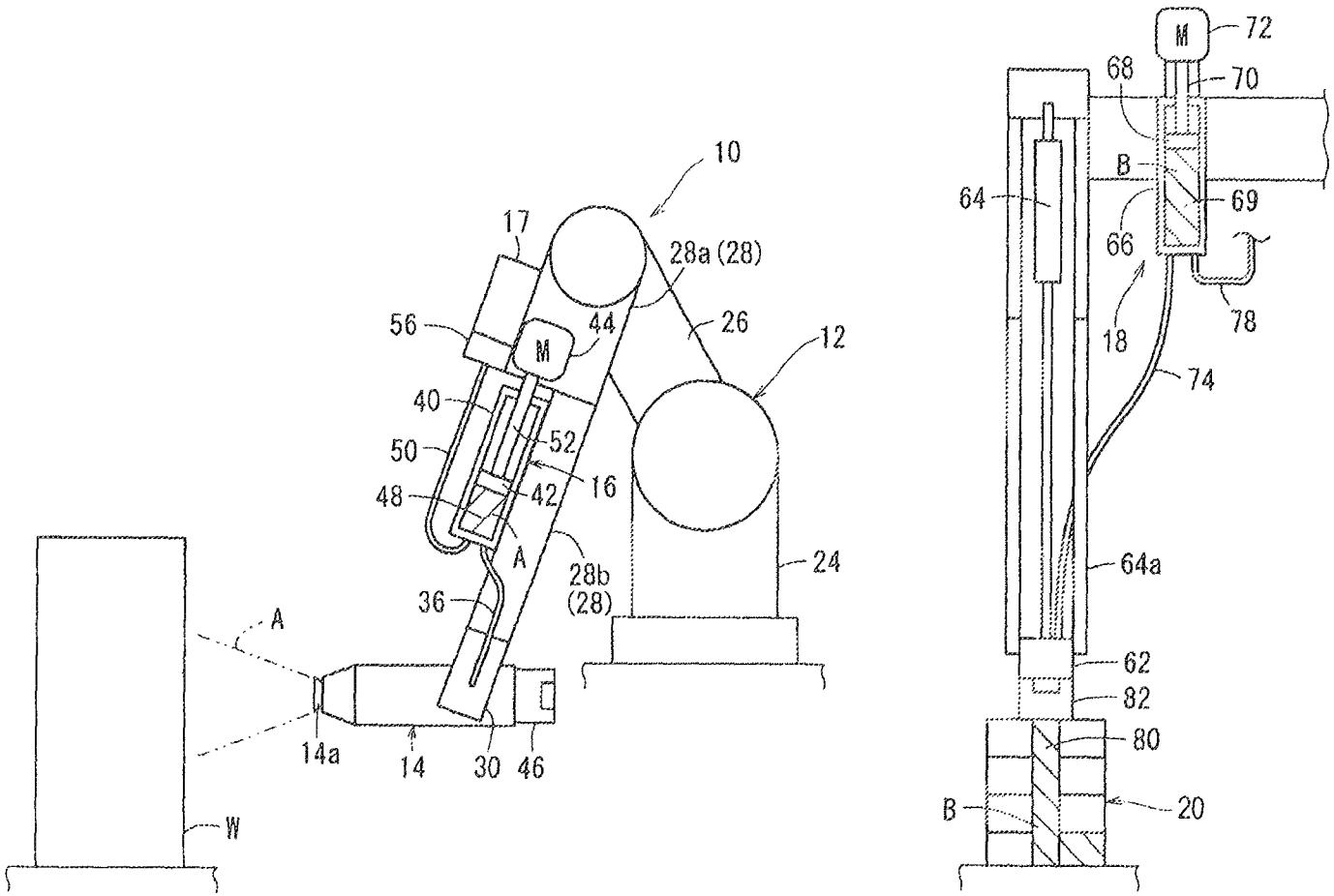
FIG. 5 is a view explaining an operation of an application part during coating.

First, the application process will be described. FIG. 5 is a view explaining an operation of an application part during coating. When the paint A is applied on the work-piece (W), the control part (reference numeral 32 in FIG. 3) controls the actuation of the articulated portions (the turning part 24, the base end of the first arm 26, the base end of the second arm 28 and a pair of sandwich plates 30) of the coating robot 12 to cause the rotary atomizing head 14*a* of the coating gun 14 to face a predetermined area of the work-piece W. Further, the control part opens the first trigger valve (reference numeral 38 in FIG. 3) to communicate the reservoir 48 of the main cylinder 16 with the gun's inner paint path (reference numeral 34 in FIG. 3) of the coating gun 14, while controlling an operation (an operation such as rotating of the rotary atomizing head 14*a* or applying of high voltage) of the coating gun 14.

Furthermore, based on a command from the control part, the drive motor 44 for main cylinder is driven to advance the piston 42 and thus the paint A filled in the reservoir 48 is extruded. Thereby, the paint A enters the gun's inner paint path 34 of the coating gun 14 via the main supply pipe 36. And then, the paint A is directed to the rotary atomizing head 14*a* of the coating gun 14 by the gun's inner paint path and sprayed from the rotary atomizing head 14*a*. That is, in the paint supply system 10, it is possible to smoothly supply the paint A from the main cylinder 16 to the coating gun 14 by the extruding force of the piston 42.

Next, the cleaning process for primary supply side will be described. During application of paint by the coating gun 14 in the application process, cleaning for the sub-cylinder 18 disconnected from the main cylinder 16 and the CCV 20 is performed. In this case, the actuator 64 is driven to move the second connection part 62 downward. And then, the second connection part 62 is connected to the third connection part 82 of the CCV 20 which is placed in a vertically downward position in FIG. 3. After such a connection, the third connection valve of the third connection part 82 is opened and the second connection valve of the second connection part 62 is opened, based on a command from the control part 32. Thereby, a reservoir 69 of the sub-cylinder 18 and the CCV space 80 of the CCV 20 are communicated with each other.

Next, the cleaning supply valves WS for supplying the cleaning water to the CCV 20 is opened and the dump valve 76 disposed in the sub-disposal pipe 78 is opened. And, the cleaning water is supplied from the cleaning supply valves WS to the CCV space 80. Then, the cleaning water is supplied from the CCV space 80 to the reservoir 69 of the sub-cylinder 18 by a pumping power from a cleaning water source. In this case, the drive motor 72 for sub-cylinder is driven to retract the piston 68 and thus the cleaning water can be supplied to the reservoir 69. Thereby, residual paint A remaining the CCV space 80 or the reservoir 69 of the sub-cylinder 18 is diluted by the cleaning water. The cleaning water mixed with the residual paint A is discharged from the disposal part through the sub-disposal pipe 78. At this time, the residual paint A diluted by the cleaning water may be forcibly extruded to the disposal part by advancing the piston 68 retracted.

Next, the cleaning supply valve WA for supplying the cleaning air to the CCV 20 is opened. And, the cleaning air is supplied from the cleaning supply valves WA to the CCV space 80. Then, the cleaning air is supplied from the CCV space 80 to the reservoir 69 of the sub-cylinder 18 by a pumping power from a cleaning air source. The residual paint A (including cleaning water) remaining the reservoir 69 is extruded by the cleaning air and discharged to the disposal part. As such, in the paint supply system 10, the CCV 20 and the sub-cylinder 18 can be easily cleaned by the cleaning water and the cleaning air. Of course, in this cleaning process, it is also possible that the cleaning supply valve WA for supplying the cleaning liquid is opened to perform cleaning by the cleaning liquid.

Next, the primary supply process will be described. After the cleaning process for primary supply side, the next applied paint B is supplied to the sub-cylinder. In this case, the supply valve Pb for supplying the paint B is opened in a state where the second connection part 62 and the third connection part 82 are connected to each other. And, the paint B is supplied from the supply valve Pb to the CCV space 80. Then, the paint. B is supplied from the CCV space 80 to the reservoir 69 of the sub-cylinder 18 by a pumping power from a source of the paint B. At this time, the drive motor 72 for sub-cylinder is driven to retract the piston 68 and thus the paint B can be supplied from the CCV space 80 to the reservoir 69, without introducing air to the reservoir 69. As a result, the next applied paint B is supplied to the reservoir 69 of the sub-cylinder 18.

As the sub-cylinder 18 is filled with the paint B, the second connection valve of the second connection part 62 is closed and the supply valve Pb for supplying the paint B is closed. And, the actuator 64 is driven to move the second connection part 62 upward and thus the second connection part is disconnected from the third connection part 82. The second connection part 62 returns to its origin position by such a movement.

Next, the cleaning process for application side will be described. As the spray of the coating gun 14 is stopped, the control part 32 stops the driving of the drive motor 44 for main cylinder and controls the operation of the articulated portions of the coating robot 12 to cause the coating gun 14 to be spaced apart from the work-piece W. And then, the drive motor 44 for main cylinder is driven to advance the piston 42 of the main cylinder 16. In this way, the residual paint A remaining in the reservoir 48 is discharged from the coating gun 14 through the main supply pipe 36 and the gun's inner paint path 34. Here, a drain board as a collection part for collecting paint is provided on a lower side (bottom side) of the coating robot 12 in the coating room. Thereby, the paint A is dropped on the drain board and thus can be collected.

As the residual paint is discharged, the second trigger valve 58 of the cleaning part 17 is opened and the cleaning supply valves WS for supplying the cleaning water to the cleaning part 17 is opened. And, the cleaning water is supplied from the cleaning supply valves WS. Then, the cleaning water is supplied from the cleaning fluid space 54 to the reservoir 48 of the main cylinder 16 by a pumping power (circulation pressure) from a cleaning water source. When the cleaning fluid is introduced, the drive motor 44 for main cylinder may be driven to retract the piston 42. Thereby, the supply of the cleaning water to the reservoir 48 is promoted. The residual paint A remaining in the reservoir 48 is diluted by the cleaning water introduced into the reservoir 48. The cleaning water mixed with the residual paint A in the reservoir 48 is discharged from the rotary atomizing head 14*a* of the coating gun 14 via the main supply pipe 36 and the gun's inner paint path 34.

Next, the cleaning supply valves WS is closed and the cleaning supply valve WA for supplying the cleaning air to the cleaning part 17 is opened. And, the cleaning air is supplied from the cleaning supply valve WA to the cleaning fluid space 54. Then, the cleaning air is supplied to the reservoir 48 of the main cylinder 16 by a pumping power from a cleaning air source. The residual paint A (including cleaning water) remaining the reservoir 48 is extruded by the cleaning air and discharged from the coating gun 14. Since the cleaning water or the cleaning air is supplied from the cleaning part 17 in such a way, the main cylinder 16 and the coating gun 14 can be cleaned independently of the sub-cylinder 18 and the CCV 20.

Next, the moving process will be described. After the cleaning process for application side (or while performing the cleaning process for application side), the control part 32 drives the coating robot 12 to transfer the coating gun 14 to a predetermined position opposite to the work-piece W. As illustrated in FIG. 1, the predetermined position refers to a position of vertically downward of the second connection part 62 and also between the second connection part 62 and the third connection part 82 of the CCV 20. In the predetermined position, the coating robot 12 causes the rotary atomizing head 14*a* of the coating gun 14 to face downward so that the rotary atomizing head is opposed to the third connection part 82. Further, the coating robot 12 causes a rear end of the coating gun 14 to face upward so that the connecting surface of the first connection part 46 is opposed to the connecting surface of the second connection part 62. That is, the coating gun 14 is positioned in a predetermined position so that a part of a central axis thereof is matched with an axis connecting the second connection part 62 and the third connection part 82.

Figure 6:
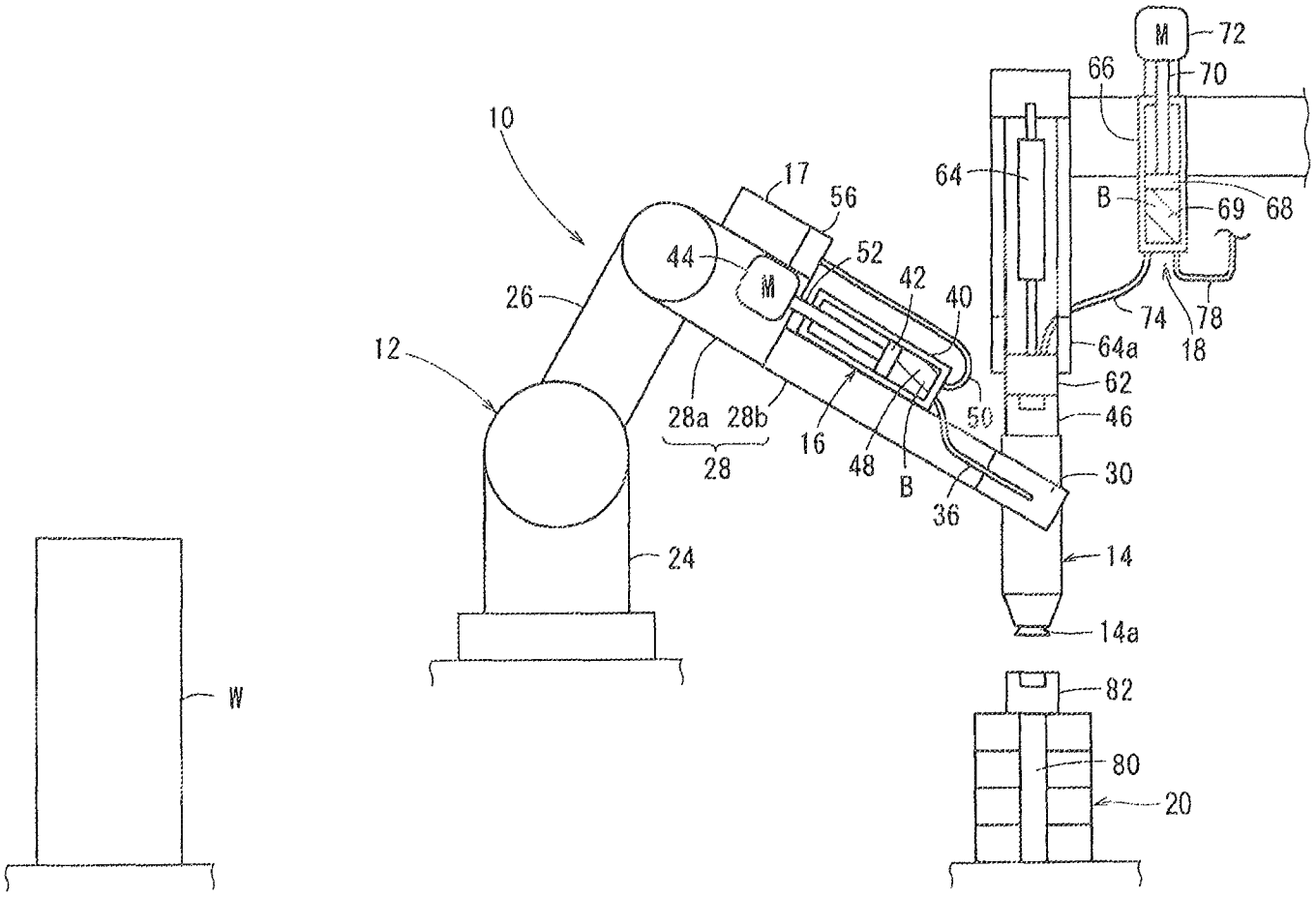
FIG. 6 is a view explaining an operation when connecting a first cylinder device and a second cylinder device.

Next, the connection process will be described. FIG. 6 is a view explaining an operation when connecting the main cylinder 16 and the sub-cylinder 18. The second connection part 62 is moved downward and thus connected to the first connection part 46. After such a connection, the control part (reference numeral 32 in FIG. 3) opens the first connection valve of the first connection part 46 and opens the second connection valve of the second connection part 62. Thereby, the reservoir 69 of the sub-cylinder 18, the sub-supply pipe 74, the second connection part 62, the first connection part 46, the gun's inner paint path (reference numeral 34 in FIG. 3), the main supply pipe 36 and the reservoir 48 of the main cylinder 16 are communicated.

Next, the secondary supply process will be described. After the connection process, while maintaining the communication state mentioned above, the drive motor 44 for main cylinder is driven to retract the piston 42 of the main cylinder 16 and the drive motor 72 for sub-cylinder is driven to advance the piston 68 of the sub-cylinder 18. At this time, increasing rate of volume of the reservoir 48 and decreasing rate of volume of the reservoir 69 can be interlocked to each other by synchronizing the retract of the piston 42 and the advance of the piston 68. Further, it is possible to supply paint from the sub-cylinder 18 to the main cylinder 16 without large variation of the internal pressures of two reservoirs 48, 69. As a result, it is possible to supply the paint B from the sub-cylinder 18 to the main cylinder 16 at high rate. Further, it is possible to suppress the leakage of the paint B from the cylindrical bodies 40, 66 and the entrance of air during supply of the paint B.

By referring to FIG. 1, the paint supply system 10 is configured so that next applied paint is supplied from the CCV 20 to the sub-cylinder 18, during application of paint by the coating gun 14 (i.e., while the main cylinder 16 supplies paint to the coating gun 14). In this way, it is possible to supply the paint from the sub-cylinder 18 to the main cylinder 16, after application. In this case, since the paint can be discharged by the extrusion force by the piston 68 of the sub-cylinder 18 and absorbed by the retraction force by the piston 42 of the main cylinder 16, it is possible to smoothly supply paint to the reservoir 48 of the main cylinder 16 in a short time, as compared to a configuration that paint is supplied to the main cylinder by a pumping power from the supply pipe.

Furthermore, when carrying out the color change of paint, the paint supply system 10 is configured so that the CCV 20 and the sub-cylinder 18 can be cleaned and the next applied paint can be supplied to the sub-cylinder 18 during application of paint by the coating gun 14. Meanwhile, since the cleaning fluid is supplied in a short cleaning interval by cleaning the coating gun 14 and the main cylinder 16 by the cleaning part 17 after application, it is possible to shorten a cleaning time and also to reduce a loss of paint. As a result, an operation time required for execution of the color change of paint can be significantly shortened. Accordingly, it is possible to improve efficiency of a coating operation. When cleaning (the cleaning process for application side) of the main cylinder 16 is simultaneously carried out during transfer (during the moving process) of the coating gun 14 by the coating robot 12 after application, the operation efficiency of the color change is further improved. Of course, paint may be supplied from the cleaning part 17 to clean the main cylinder 16 and the sub-cylinder 18 together in a state where the main cylinder 16 and the sub-cylinder 18 are connected to each other.

Second Embodiment

In the paint supply system 10 according to the first embodiment, the actuator 64 is used as a driving source of the second connection part 62 and the drive motor 72 for sub-cylinder is used as a driving source for extruding the paint when paint is supplied to the main cylinder 16. By the way, energy reservation has been demanded from the viewpoint of global environmental issues. For this reason, it is desirable that the number of driving source is small. Accordingly, hereinafter, an example of using only one driving source will be described when paint is supplied to the main cylinder 16.

Figure 7:
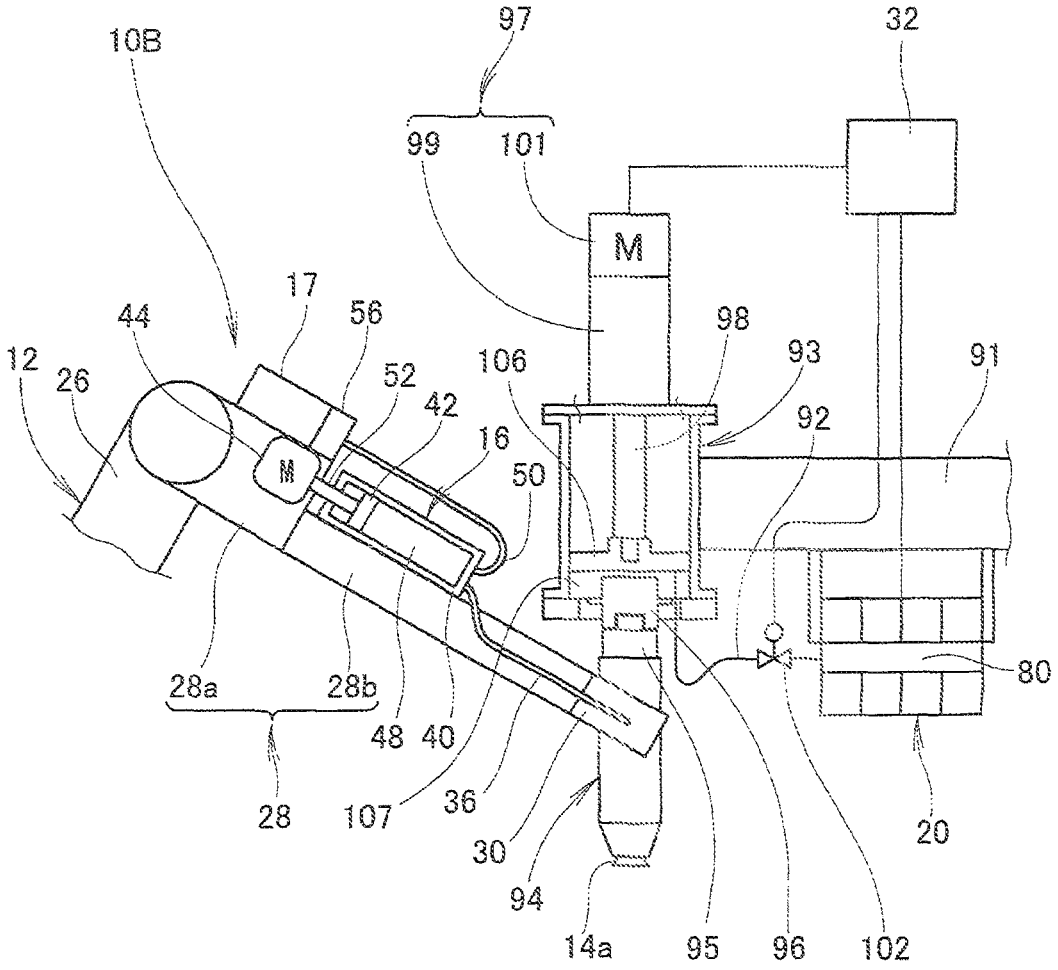
FIG. 7 is a view illustrating a second embodiment.

In FIG. 7, the element common to FIG. 1 will be denoted by the same reference numeral and the duplicated explanation thereof will be omitted. Main change is that one driving source is used to advance the second connection part and to extrude the paint. The paint supply system 106 includes the CCV 20 supported on a supporting portion 91 and a sub-cylinder 93 (will be described in detail later) which is supported on the supporting portion 91 and connected to the CCV space 80 of the CCV 20 via a primary supply pipe 92. Further, the sub-cylinder temporarily stores the paint to be supplied to the main cylinder 16.

A convex first connection part 95 (will be described in detail later) is provided in a rear end of a coating gun 94. A concave second connection part 96 (will be described in detail later) is provided in a rear end of the sub-cylinder 93 and connected to the first connection part 95.

A driving source 97 is provided in an upper end of the sub-cylinder 93 and drives a piston (will be described later) in the interior of the sub-cylinder 93. The driving source 97 includes an electric mechanism 99 and an electric motor 101. The electric mechanism is attached to an upper end of the sub-cylinder 93 and configured to advance and retract a shaft 98. The electric motor has an output shaft connected to the electric mechanism. Although the driving source 97 is provided in the upper end of the sub-cylinder 93 in the present embodiment, an arrangement position of the driving source 97 is not limited to such a position. For example, the driving source may be supported on a periphery of the sub-cylinder 93 or the supporting portion 91.

The shaft 98 is advanced or retracted by transmitting a driving force of the electric motor 101 to the electric mechanism 99 and transmitting the driving force from the electric mechanism 99 to the shaft 98. It is preferable that the driving source 91 is a combination of the electric motor 101 and the electric mechanism 99. Alternatively, a pneumatic cylinder may be employed as the driving source 97.

The electric motor 101 and a primary supply valve 102 provided in the middle of the primary supply pipe 92 are controlled by the control part 32.

Figure 8:
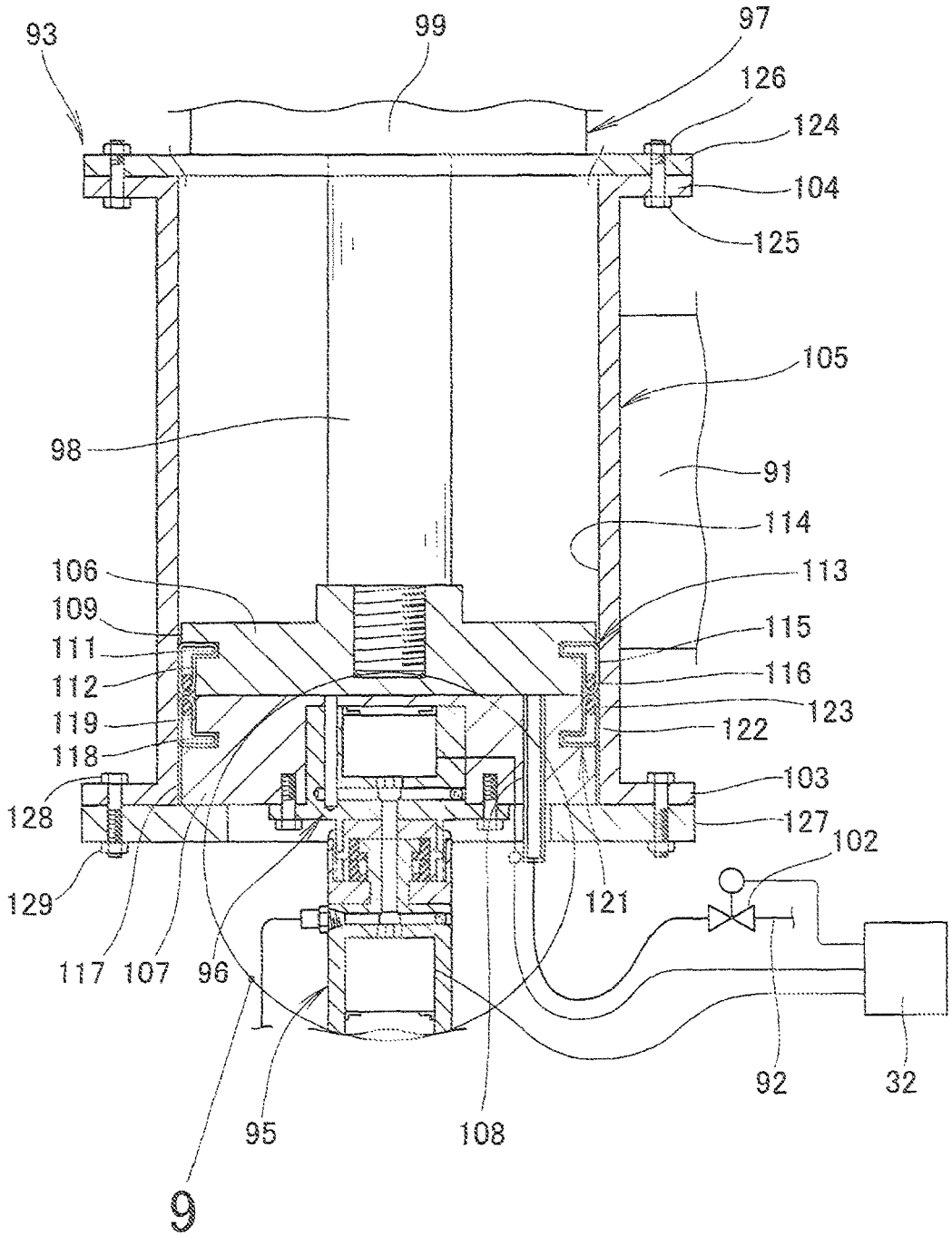
FIG. 8 is a cross-sectional view illustrating a second cylinder device illustrated in FIG. 7.

A configuration of the sub-cylinder 93 will be described by referring to FIG. 8. As illustrated in FIG. 8, the sub-cylinder 93 includes a cylinder 105 extending in a cylindrical shape, a driving piston 106, a driven piston 107, the second connection part 96, a primary supply valve 102 and the driving source 97 for pushing back the driving piston 106. The cylinder 105 has a coating gun side flange 103 on an end of the coating gun (reference numeral 94 in FIG. 7) side and a driving side flange 104 on an end of the driving source 97 side. The driving piston 106 is movably provided in the cylinder 105 and connected to the shaft 98 of the driving source 97 which is connected to the driving side flange 104. The driven piston 107 contacts the driving piston 106 to be freely spaced apart therefrom and is movably provided in the cylinder 105. The second connection part 96 is provided on a side of the driven piston 107 opposite to the driving source 97. Further, the second connection part 96 allows the outflow of the paint when being connected to the first connection part 95 and stops the outflow of the paint when being disconnected from the first connection part 95. The primary supply valve 102 is connected to the primary supply pipe 92 and a short pipe 108 as a through passage attached to the driven piston 107. The primary supply valve 102 is opened when filling the paint between the driving piston 106 and the driven piston 107.

In addition, a piston support member 127 for supporting the driven piston 107 is connected to the coating gun side flange 103 of the cylinder 105.

Next, an operation of the driving piston 106 and the driven piston 107 will be described. As the electric motor (reference numeral 101 in FIG. 7) is rotated forward based on a command of the control part 32, the shaft 98 is retracted and the driving piston 106 returns toward the driving source 97. At this time, although the driven piston 109 is slightly separated from the driving piston 106, the driven piston 107 returns together with the driving piston 106 toward the driving source 97 by an atmospheric pressure because a negative pressure is caused between the driving piston 106 and the driven piston 107.

Next, a seal structure of the driving piston 106 and the driven piston 107 will be described. An outer peripheral surface 109 of the driving piston 106 is provided with a concave driving circumferential groove 111 and a driving small diameter part 112 provided adjacent to the concave driving circumferential groove 111. The driving small diameter part 112 is formed in a diameter smaller than an outer diameter of the outer peripheral surface 109. A driving seal member 113 is attached to the driving circumferential groove 111 and the driving small diameter part 112. The driving seal member 113 includes a thin driving resin material 115 fitted into the driving circumferential groove 111 and a driving O-ring 116 surrounded by the driving resin material 115. The driving resin material 115 is engaged with the driving small diameter part 112 and contacts an inner peripheral surface 114 of the cylinder 105. The driving O-ring 116 is configured to extrude the driving resin material 115 toward the inner peripheral surface 114 of the cylinder 105.

An outer peripheral surface 117 of the driven piston 107 is provided with a concave driven circumferential groove 118 and a driven small diameter part 119 provided adjacent to the concave driven circumferential groove 118. The driven small diameter part 119 is formed in a diameter smaller than an outer diameter of the outer peripheral surface 117. A driven seal member 121 is attached to the driven circumferential groove 118 and the driven small diameter part 119. The driven seal member 121 includes a thin driven resin material 122 fitted into the driven circumferential groove 118 and a driven O-ring 123 surrounded by the driven resin material 122. The driven resin material 122 is engaged with the driven small diameter part 119 and contacts an inner peripheral surface 114 of the cylinder 105. The driven O-ring 123 is configured to extrude the driven resin material 122 toward the inner peripheral surface 114 of the cylinder 105.

The driving resin material 115 of the driving seal member 113 is a material for improving a sliding ability of the driving piston 106 relative to the cylinder 105 when the driving piston 106 is advanced or retracted. In addition, the driving O-ring 116 seals a clearance between the inner surface 114 of the cylinder 105 and the outer peripheral surface 109 of the driving piston 106. That is, the driving seal member 113 can improve the sliding ability of the driving piston 106 and seal a clearance between the cylinder 105 and the driving piston 106. The driven seal member 121 has the same function as the driving seal member 113.

Figure 9:
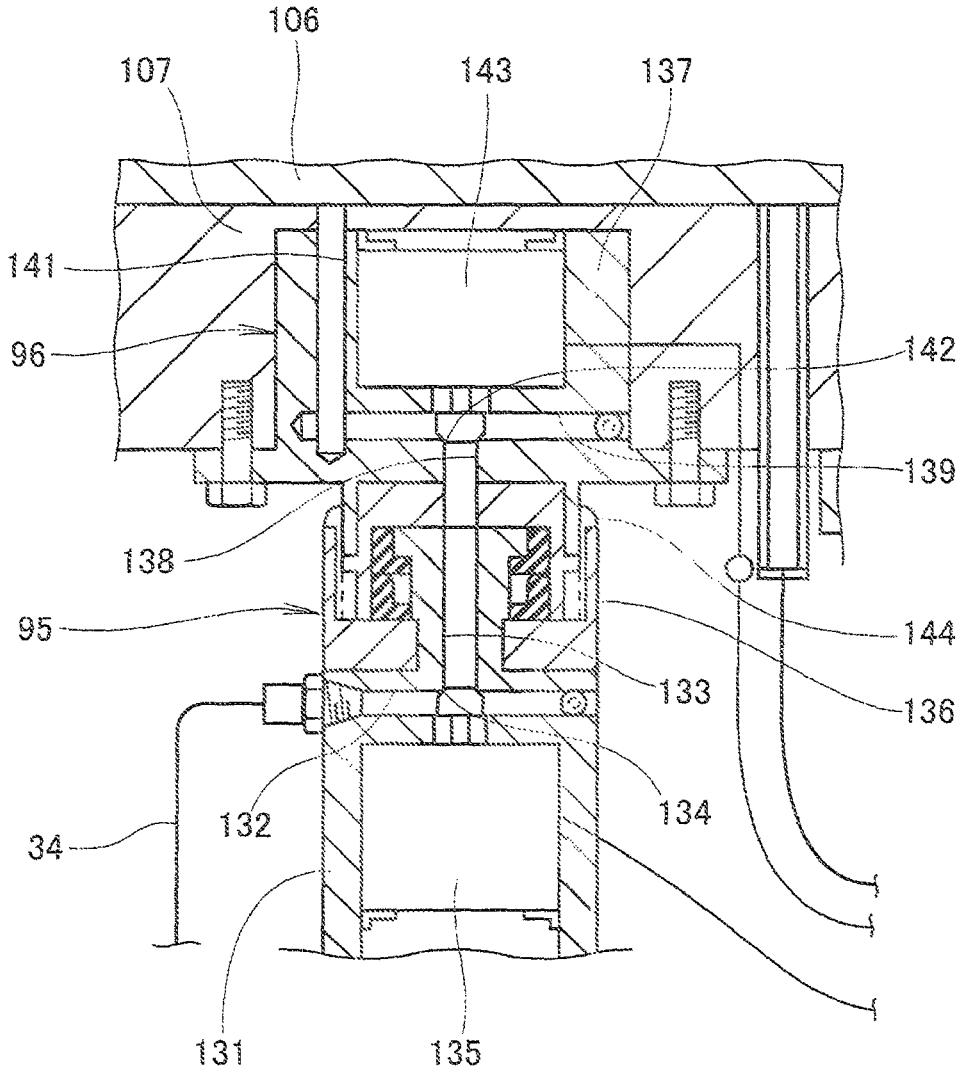
FIG. 9 is a partially enlarged view illustrating a portion 9 of FIG. 8.

The structure of the first connection part 95 and the second connection part 96 will be described by referring to FIG. 9. As illustrated in FIG. 9, the first connection part 95 includes a first main body 131 supported on a rear end of the coating gun (reference numeral 94 in FIG. 7), a first supply passage 132 formed in the first main body 131 in a diametric direction of the cylinder (reference numeral 105 in FIG. 8), a second supply passage 133 provided to intersect the first supply passage 132, a first outflow control valve 135 and a first connection member 136 provided in an upper end of the first main body 131. The first supply passage 132 is connected to the gun's inner paint path 34 and the paint passes through the first supply passage 132. The first outflow control valve 135 has a valve body contacting a first supply intersection part 134 and opens or closes the first supply intersection part 134 by actuating the valve body. A passage 132 and a passage 133 intersect at the first supply intersection part 134.

The second connection part 96 includes a second main body 137 supported on the driven piston 107, a third supply passage 138 opened on the second main body 137 in an axial direction of the cylinder and connected to the second supply passage 133, a fourth supply passage 139 provided to intersect the third supply passage 138, a fifth supply passage 141 provided to intersect the fourth supply passage 139 of an outer wall side of the cylinder and penetrating toward the driving piston 106, a second outflow control valve 143 and a second connection member 144 provided in a coating gun side of the second main body 137. The second outflow control valve 143 has a valve body contacting a second supply intersection part 142 and opens or closes the second supply intersection part 142 by actuating the valve body. A passage 138 and a passage 139 intersect at the second supply intersection part 142. An air operated valve can be suitably employed as the first outflow control valve 135 and the second outflow control valve 143.

The first outflow control valve 135 and the second outflow control valve 143 are connected to the control part (reference numeral 32 in FIG. 8) via a cable. The opening/closing of the first outflow control valve 135 and the opening/closing of the second outflow control valve 143 are performed in accordance with a command from the control part.

When the control part issues a command to open the first outflow control valve 135 and the second outflow control valve 143 in a state where the second connection part 96 is connected to the first connection part 95, the paint can pass through the passages 141, 139, 138, 133, 132. That is, the outflow of the paint is allowed when the second connection part 96 is connected to the first connection part 95. An operation for filling paint between the driving piston 106 and the driven piston 107 will be described later.

Meanwhile, when disconnecting the second connection part 96 from the first connection part 95, the control part issues a command to close the first outflow control valve 135 and the second outflow control valve 143. That is, the outflow of the paint can be stopped when the second connection part 96 is disconnected from the first connection part 95.

Figure 10:
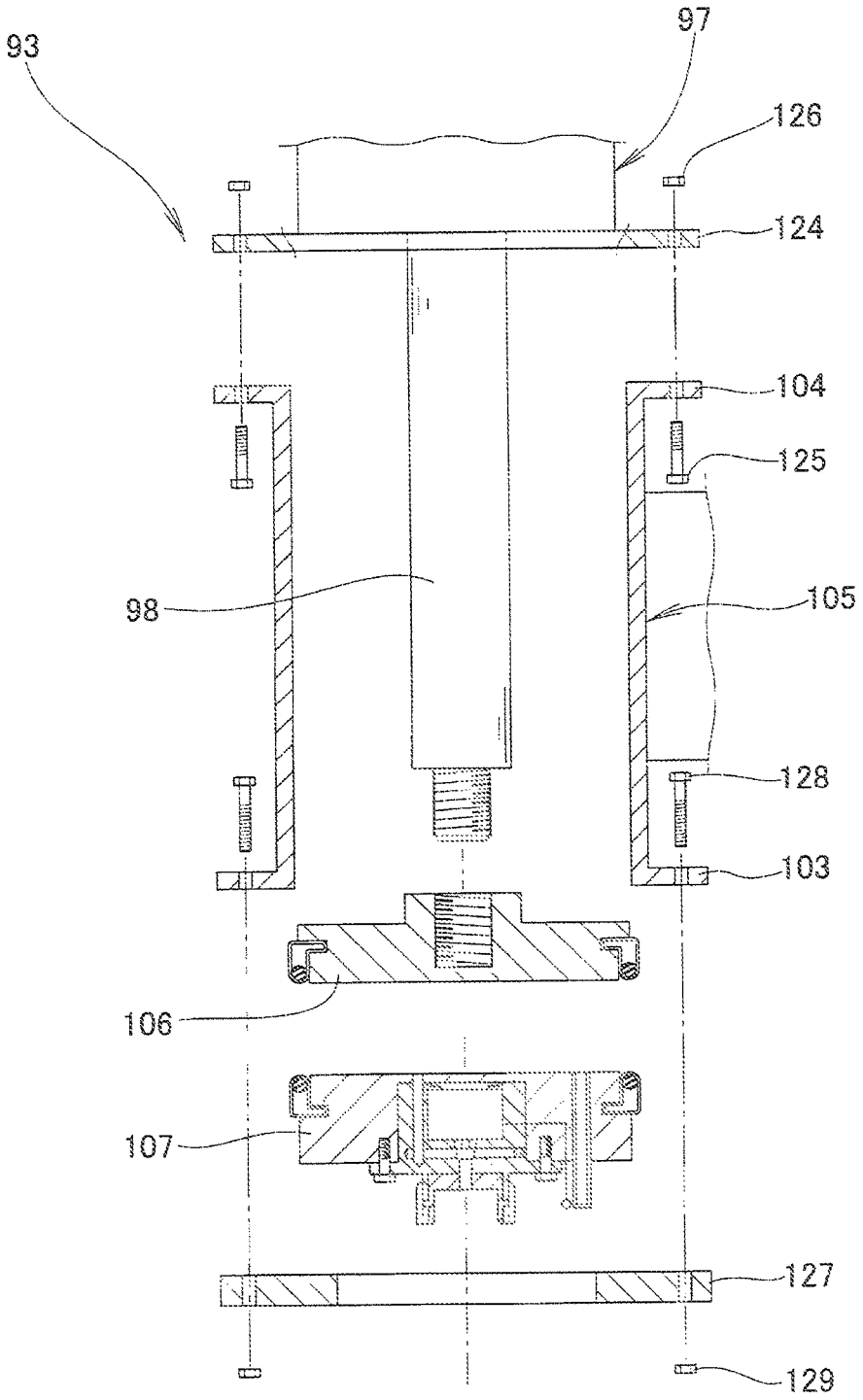
FIG. 10 is an exploded view illustrating the second cylinder device illustrated in FIG. 7.

Disassembling sequence of the sub-cylinder 93 will be described by referring to FIG. 10. As illustrated in FIG. 10, the driving source 97 is disassembled from the cylinder 105 by removing bolts 125 and nuts 126 from a driving source connection part 124 and the driving side flange 104. Next, the driving piston 106 is disassembled from a leading end of the shaft 98 of the driving source 97. Next, the piston support member 127 is disassembled from the cylinder 105 by removing bolts 128 and nuts 129 from the coating gun side flange 103 and the piston support member 127. In this way, the driving piston 106 and the driven piston 107 are taken out of the cylinder 105.

Figure 11A:
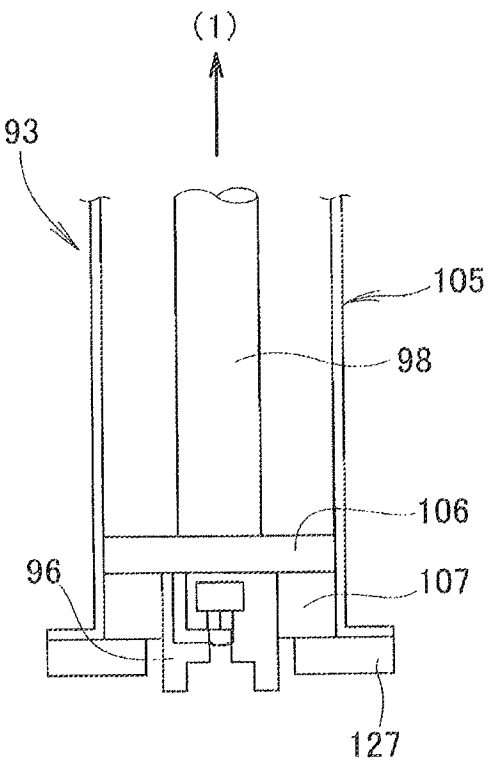
FIGS. 11(*a*) to (*c*) are views explaining a paint filling process.
Figure 11B:
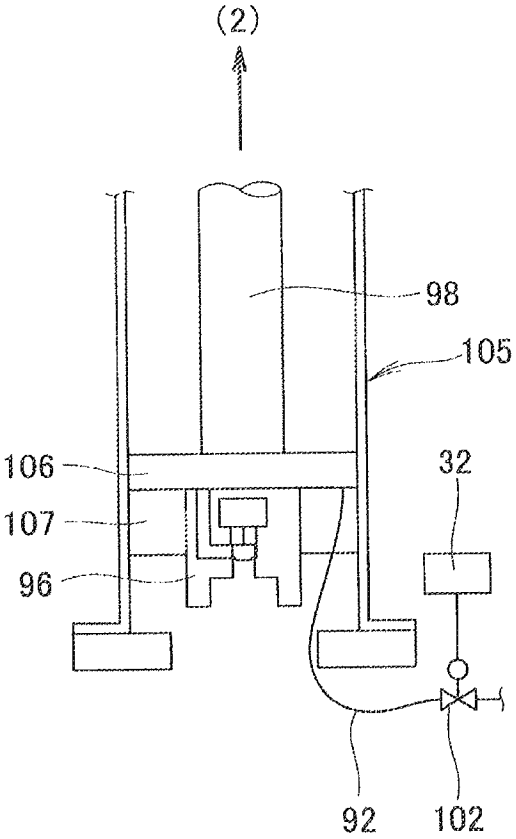
Figure 11C:
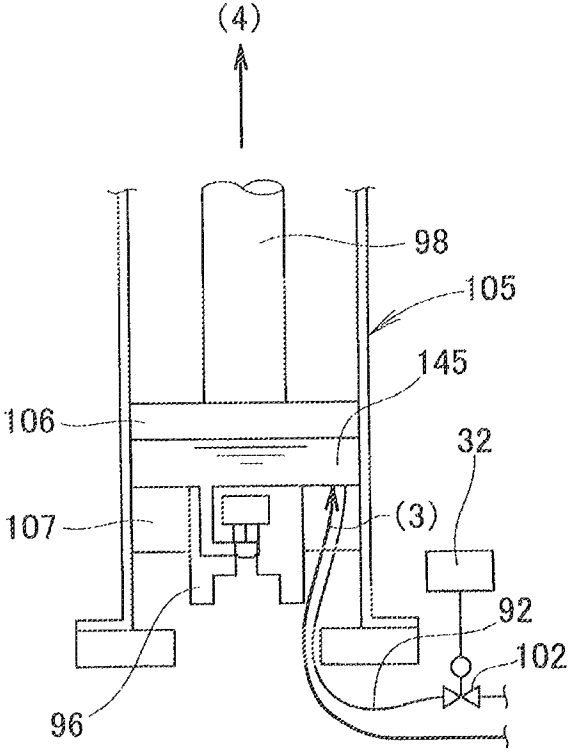

Next, an operation of the sub-cylinder 93 mentioned above will be described. As illustrated in FIG. 11(*a*), the driving source (reference numeral 97 FIG. 7) returns the shaft 98 as indicated by arrow (1) and thus the driving piston 106 and the driven piston 107 return toward the driving source side.

In FIG. 11(*b*), an operation of the driving source is temporarily stopped. Next, the control part 32 issues a command to open the primary supply valve 102. Thereby, a preparation for filling the paint is completed. In this state, the driving source (reference numeral 97 FIG. 7) further returns the shaft 98 as indicated by arrow (2).

As illustrated in FIG. 11(*c*), as the driving piston 106 returns toward the driving source, the paint 145 is introduced between the driving piston 106 and the driven piston 107 as indicated by arrow (3). The shaft 98 is further returned as indicated by arrow (4).

Figures 12A, 12B, 12C, 12D:
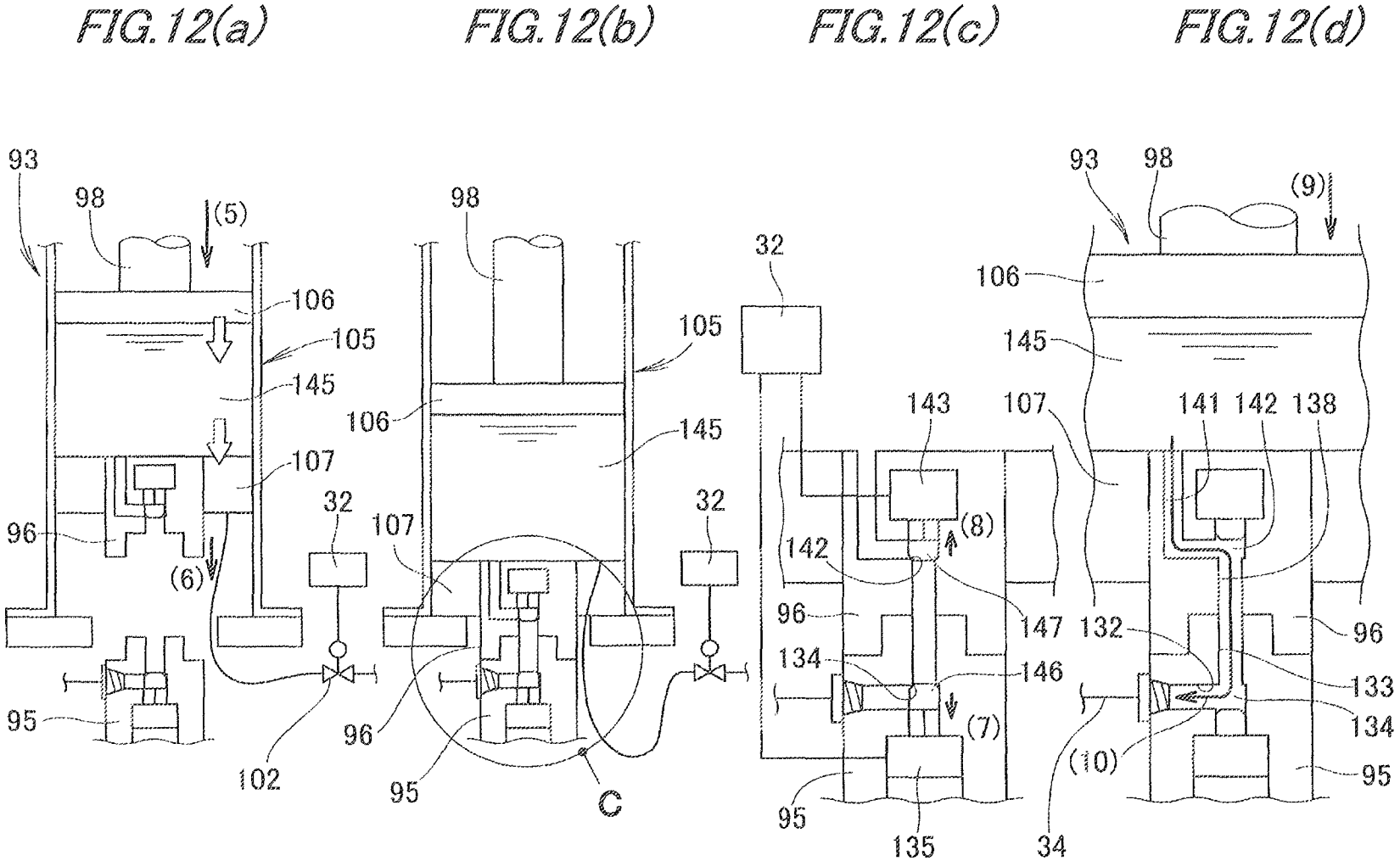
FIGS. 12(*a*) to (*d*) are views explaining a second connection part advancing process, a connection part connecting process and a secondary supply process.

As illustrated in FIG. 12(*a*), the paint 145 is filled between the driving piston 106 and the driven piston 107. As a specified time lapses, the control part 32 issues a command to close the primary supply valve 102 and therefore the primary supply valve 102 is closed.

In this state, as the shaft 98 is pushed as indicated by arrow (5), the driving piston 106 and the paint 145 are pushed as indicated by an outline arrow and the driven piston 107 is pushed by the paint 145 as indicated by an outline arrow. Accordingly, the driving piston 106, the driven piston 107 and the paint 145 filled therebetween are advanced as indicated by arrow (6).

As a result, as illustrated in FIG. 12(*b*), the second connection part 96 is connected to the first connection part 95 which is located in a standby state. FIG. 12(*c*) is an enlarged view of portion "c" of FIG. 12(*b*). As the control part 32 issues a command to open the first outflow control valve 135 and the second outflow control valve 143, the first outflow side valve body 146 is retracted as indicated by arrow (7) and the second outflow side valve body 147 is retracted as indicated by arrow (8).

As illustrated in FIG. 12(*d*), as the shaft 98 is pushed as indicated by arrow (9), the paint 145 is pushed by the driving piston 106 and passes through the fifth supply passage 141, the second supply intersection part 142, the third supply passage 138, the second supply passage 133, the first supply intersection part 134 and the first supply passage 132, as indicated by arrow (10). As a result, the paint 145 is supplied to the main cylinder (reference numeral 16 in FIG. 7) via the gun's inner paint path 34.

Next, an operation of the sub-cylinder 93 will be described in summary. The sub-cylinder 93 uses one driving source to perform the advancement of the second connection part 96 and the extrusion of the paint 145. Specifically, as illustrated in FIG. 12(*a*), after the paint 145 is filled between the driving piston 106 and the driven piston 107, the driving source pushes the driving piston 106 as indicated by arrow (5) and the pushing force of the driving piston 106 indicated by outline arrow is transmitted to the driven piston 107 via the filled paint 145. As a result, the driven piston 107 and the second connection part 96 advance as indicated by arrow (6). Further, as illustrated in FIG. 12(*d*), after the second connection part 96 is connected to the first connection part 95, the filled paint 145 is supplied from the second connection part 96 to the first connection part 95 by pushing the driving piston 106 by the driving source.

By the way, although the paint is filled by causing the driving piston 106 to be spaced apart from the driven piston 107 in FIGS. 11(*a*) to (*c*), the paint may be filled by causing the driven piston 107 to be spaced apart from the driving piston 106. Hereinafter, the example of such a case will be described.

Figure 13A:
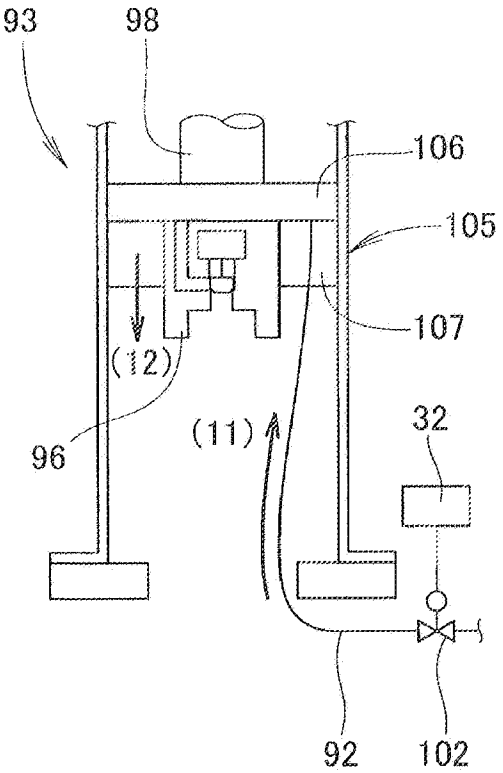
FIGS. 13(*a*) to (*c*) are views explaining another paint filling process.
Figure 13B:
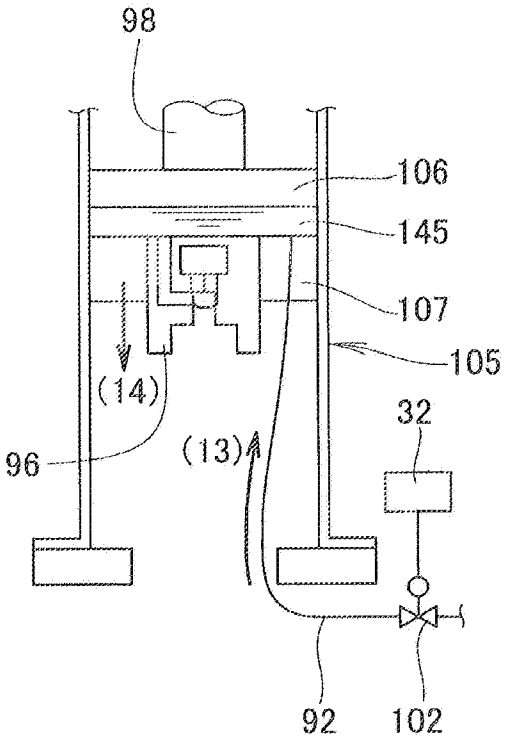
Figure 13C:
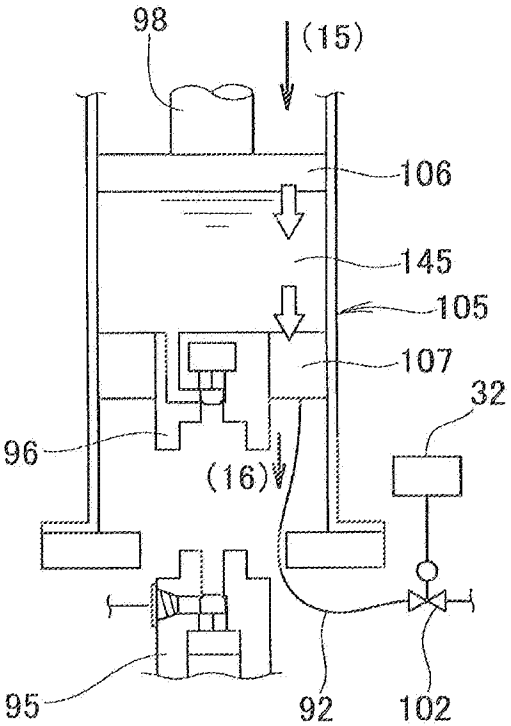

As illustrated in FIG. 13(*a*), when the control part 32 issues a command to open the primary supply valve 102 in a state where the driving piston 106 and the driven piston 107 are returned toward the driving source, the paint is introduced between the driving piston 106 and the driven piston 107, as indicated by arrow (11). The driven piston 107 is pushed by the paint and thus advances as indicated by arrow (12).

As illustrated in FIG. 13(*b*), the paint 145 starts to be filled between the driving piston 106 and the driven piston 107. The paint is continuously supplied as indicated by arrow (13) and the driven piston 107 further advances as indicated by arrow (14).

As a result, as illustrated in FIG. 13(*c*), the paint 145 is filled between the driving piston 106 and the driven piston 107. As a specified time lapses, the control part 32 issues a command to close the primary supply valve 102 and therefore the primary supply valve 102 is closed. As the shaft 98 and the driving piston 106 are pushed as indicated by arrow (15), the driven piston 107 is pushed via the paint 145. Accordingly, the driving piston 106, the driven piston 107 and the paint 145 filled therebetween are advanced as indicated by arrow (16).

Figure 14:
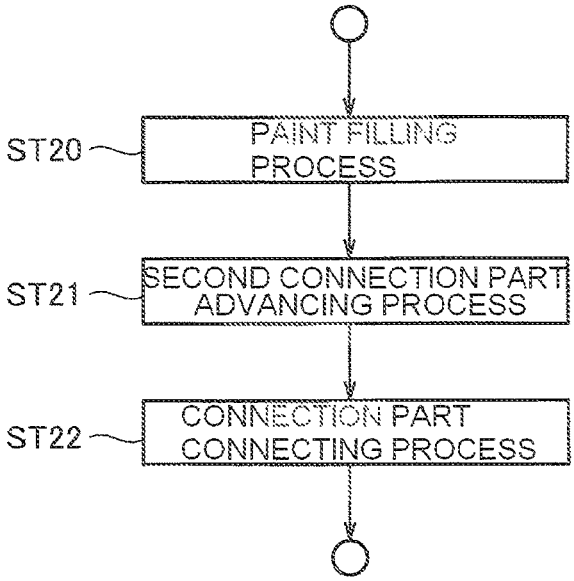
FIG. 14 is a flowchart illustrating a connecting process.

A connection process performed using the sub-cylinder 93 will be described by referring to FIG. 14. As illustrated in FIG. 14, in ST20, a paint filling process for filling the paint between the driving piston and the driven piston of the second cylinder device is carried out. Specifically, as illustrated in FIG. 11(*c*), as the driving piston 106 returns toward the driving source, the paint 145 is introduced between the driving piston 106 and the driven piston 107, as indicated by arrow (3). As the shaft 98 is further returned as indicated by arrow (4), the paint 145 is filled between the driving piston 106 and the driven piston 107.

In ST21, a second connection part advancing process for advancing the second connection part included in the driven piston is carried out by pushing the driving piston by the driving source and transmitting the pushing force from the driving piston to the driven piston via the filled paint. Specifically, in FIG. 12(*a*), as the shaft 98 is pushed as indicated by arrow (5), the paint 145 are pushed by the driving piston 106 as indicated by an outline arrow and the driven piston 107 is pushed by the paint 145 as indicated by an outline arrow.

In ST22, a connection part connecting process for connecting the second connection part to the first connection part connected to the first cylinder device is carried out by continuously pushing the driving piston by the driving source. Specifically, in FIG. 12(*a*), the driving piston 106, the driven piston 107 and the paint 145 filled therebetween are advanced, as indicated by arrow (6). As a result, the second connection part 96 is connected to the first connection part 95, as illustrated in FIG. 12(*b*). As mentioned above, the connection process includes the paint filling process, the second connection part advancing process and the connection part connecting process.

Next, a secondary supply process performed using the sub-cylinder 93 will be described. In FIG. 12(*d*), in the secondary supply process, the filled paint 145 is extruded by the second connection part as indicated by arrow (10), by further pushing the driving piston 106 by the driving piston as indicated by arrow (9).

Next, an operation of the sub-cylinder 93 will be described in summary. In FIGS. 12 (*a*) to (*d*), just one driving source included in the sub-cylinder 93 is configured to perform the connection of the second connection part 96 to the first connection part 95 in the connection part connecting process and the extrusion of the paint 145 in the secondary supply process.

Although only the driving piston 106 is moved when filling the paint in the sub-cylinder 93, as illustrated in FIGS. 11 (*a*) to (*c*), in the above description, the driven piston 107 may be slightly moved during filling of the paint 145. By the way, the quantitative property of the paint filling the sub-cylinder 93 is demanded in order to manage the used amount of paint. However, it is difficult to fill the paint by a predetermined amount each time, due to the slight movement of the driven piston 107. In addition, although only the driven piston 107 is moved when filling the paint in the sub-cylinder 93, in FIGS. 13 (*a*) to (*c*), it takes time for stopping the driven piston 107 due to a residual pressure of the paint supply pressure even when the supply of paint is stopped. Accordingly, it is difficult to fill the paint by a predetermined amount each time. That is, it is difficult to achieve the quantitative property of the paint by the paint filling method mentioned above. Accordingly, next, an example of achieving the quantitative property of the paint will be described.

Figure 15:
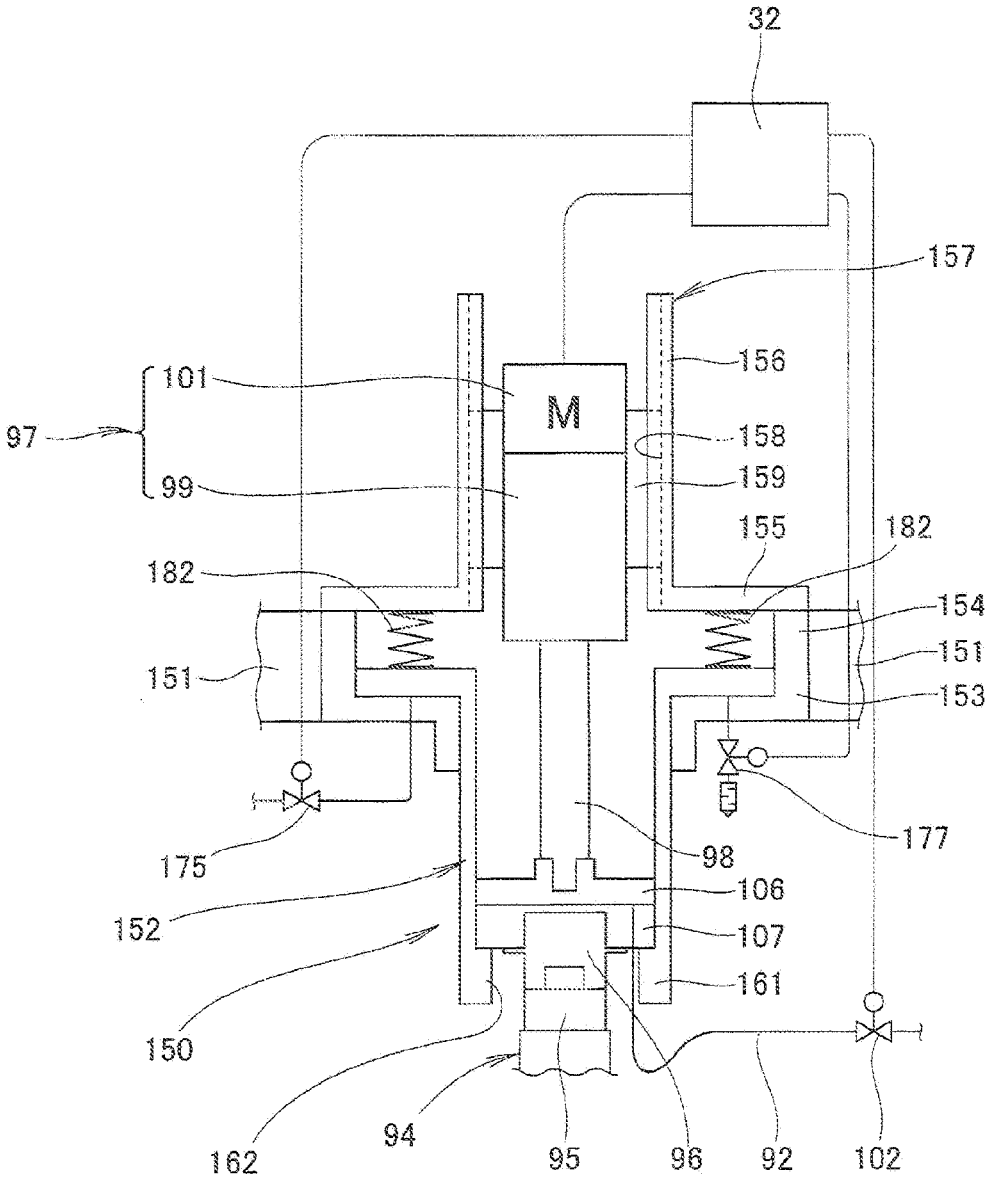
FIG. 15 is a view illustrating a modification of the second embodiment.

In FIG. 15, 7, the element common to FIG. 7 will be denoted by the same reference numeral and the duplicated explanation thereof will be omitted. Main change is that a cylinder accommodating the driving piston and the driven piston is movable. A sub-cylinder 150 includes a cylinder guide 153 (will be described in detail later) attached to a supporting portion 151, a cylinder 152 (will be described in detail later) supported on the cylinder guide 153 to freely ascend/descend, a guide member 157 and a slider 159 included in the driving source 97. The cylinder 152 accommodates the driving piston 106 and the driven piston 107. The guide member 157 includes a radial part 155 connected to a driving side end 154 of the cylinder guide 153 and an axial part 156 extending axially from the radial part 155. The slider 159 is movably engaged with a groove 158 formed in the axial part 156.

A piston supporting part 162 is provided in a connection side end 161 of the cylinder 152 and supports the driving piston 106 and the driven piston 107. Since the driving source 97 and the slider 159 are connected to the driving piston 106 via the shaft 98, the driving source 97 and the slider 159 are also supported on the piston supporting part 162.

Figure 16:
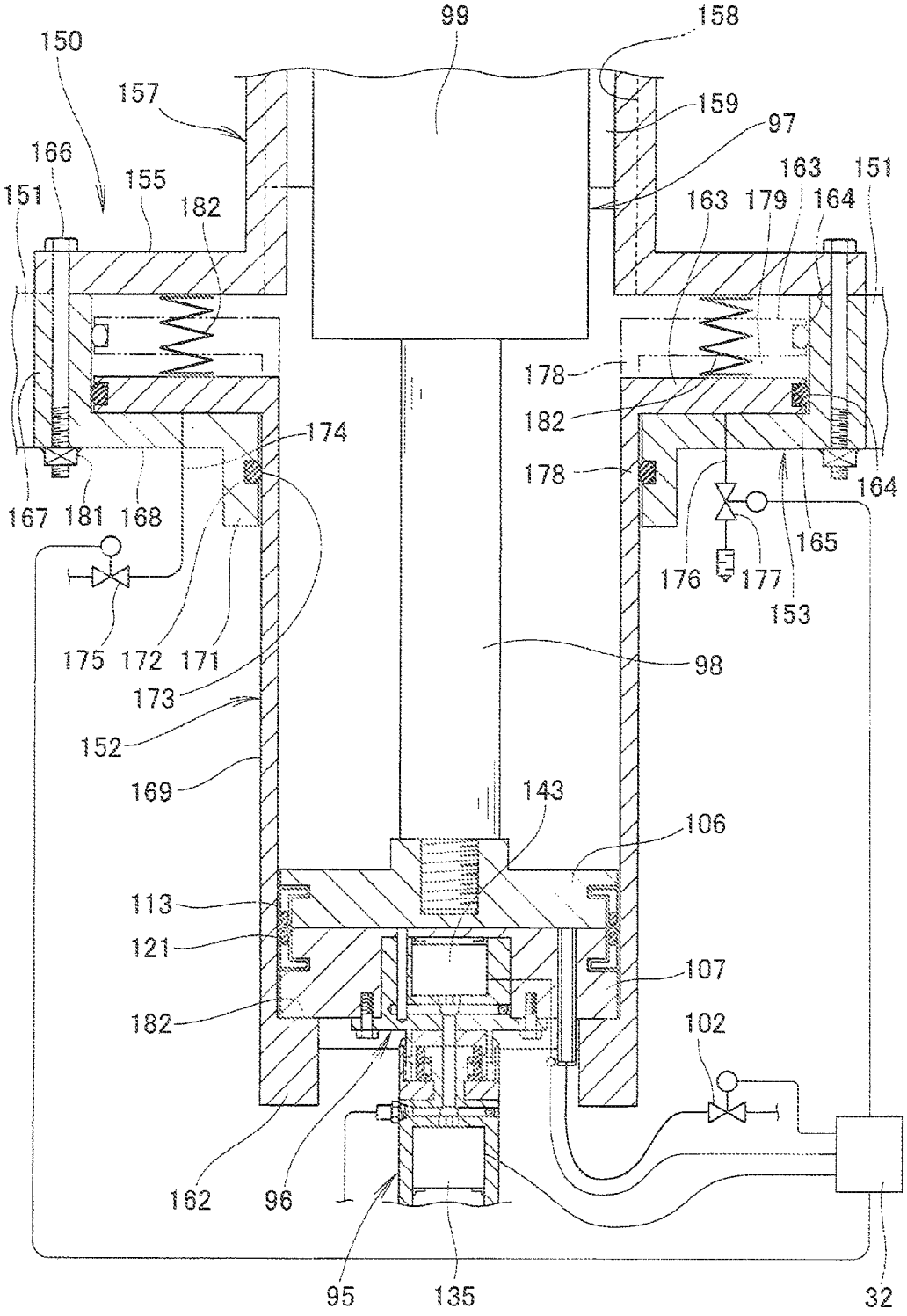
FIG. 16 is a cross-sectional view illustrating a second cylinder device illustrated in FIG. 15.

A detailed configuration of the cylinder 152 and the cylinder guide 153 will be described by referring to FIG. 16. As illustrated in FIG. 15, a piston part 163 is formed on a driving side end of the cylinder 152 and extends outward in a radial direction of the cylinder 152. Further, an outer surface of the piston part 163 is formed with a moving side O-ring groove 165 into which a moving side O-ring 164 is fitted.

The cylinder guide 153 includes a large-diameter part 167 connected to the radial part 155 by bolts 166, a ring part 168 extending from the large-diameter part 167 inward in a radial direction of the cylinder 152 and a small-diameter part 171 connected to the ring part 168 and covering an outer surface 169 of the cylinder 152. The small-diameter part 171 is formed with a stop side O-ring groove 173 into which a stop side O-ring 172 is fitted.

In addition, an air supply pipe 174 for supplying compressed air is connected to the ring part 168. An air supply valve 175 is provided in the middle of the air supply pipe 174 and opened when supplying the compressed air. Further, an air exhaust pipe 176 for exhausting compressed air is connected to the ring part 168. An air exhaust valve 177 is provided in the middle of the air exhaust pipe 176 and opened when exhausting the compressed air. The opening/closing of the air supply valve 175 and the opening/closing of air exhaust valve 177 are controlled by the control part 32.

A plurality of cylinder urging member 182 are provided between the radial part 155 of the guide member 157 and the piston part 163 and urge the cylinder 152 toward paint extrusion side thereof.

Next, an operation of the cylinder 152 will be described. As the air supply valve 175 is opened and thus compressed air is introduced between the cylinder 152 and the cylinder guide 153, the piston part 163 moves toward the guide member 157, as illustrated by an imaginary line. That is, an air chamber 179 is formed by a peripheral wall 178 of the cylinder 152, the piston part 163, the large-diameter part 167 of the cylinder guide 153 and the ring part 168 of the cylinder guide 153. The cylinder 152 can be held in a state where the cylinder is moved toward the guide member 157, by the compressed air stored in the air chamber 179. At this time, the cylinder urging member 182 is in a compressed state.

Meanwhile, as the air supply valve is closed and the air exhaust valve 177 is opened, the compressed air is exhausted from the air chamber 179 to the outside. The cylinder 152 returns to its initial position illustrated by a solid line by urging force of the cylinder urging member 182. A compressed spring may be suitably employed as the cylinder urging member 182. Since the sealing performance of the air chamber 179 is maintained by the moving side O-ring 164 and the stop side O-ring 172, there is no problem that an inner pressure of the air chamber is dropped when compressed air is supplied to the air chamber 179. Accordingly, it is possible to securely move the cylinder 152.

Figures 17A, 17B, 17C, 17D:
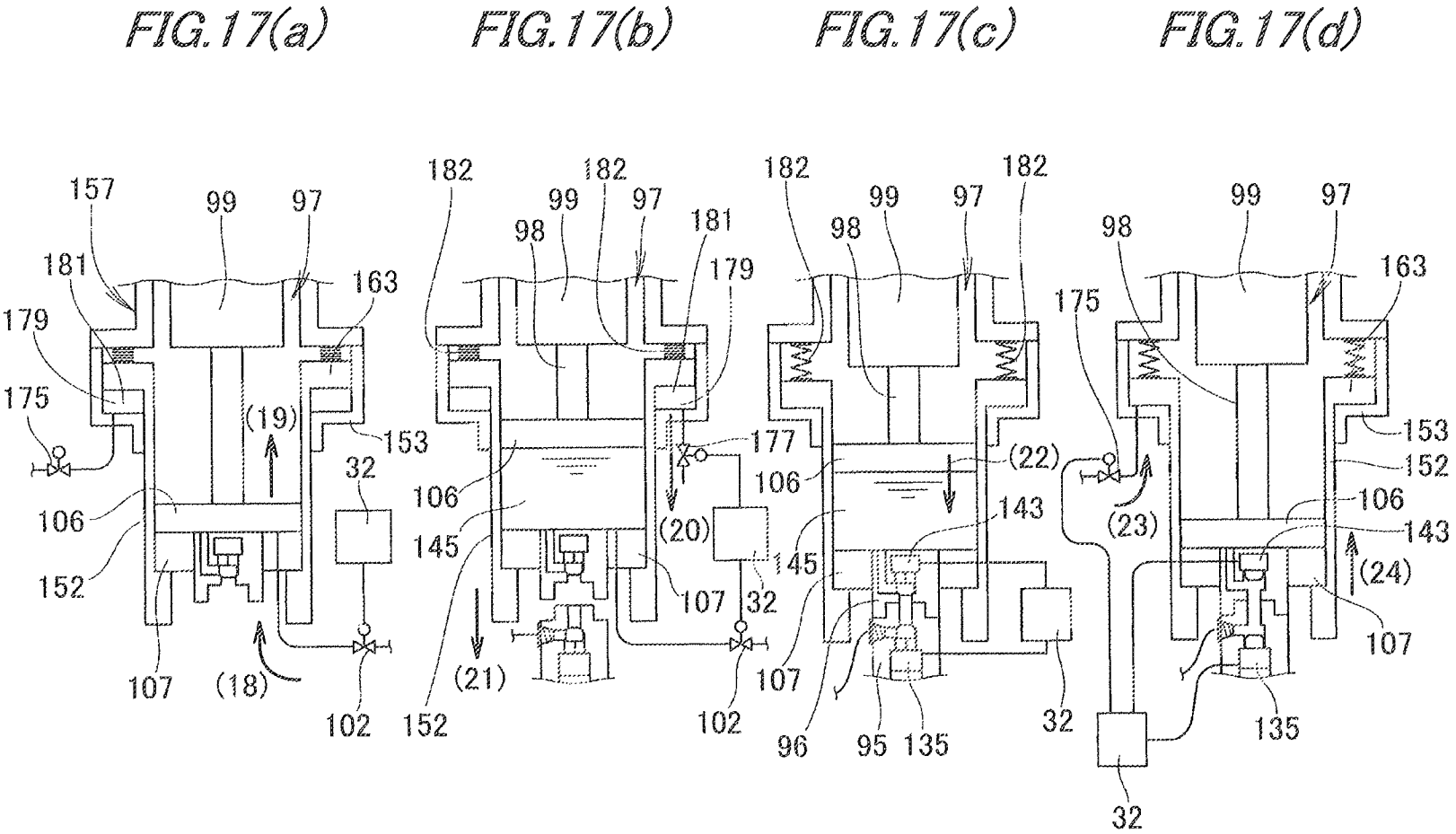
FIGS. 17(*a*) to (*d*) are views explaining an operation of the second cylinder device illustrated in FIG. 15.

An operation of the sub-cylinder 150 will be described by referring to FIG. 17. As illustrated in FIG. 17(*a*), the air chamber 179 is filled with the compressed air 181 and therefore the cylinder 152 moves toward the guide member 157. The air supply valve 175 is in a closed state. The primary supply valve 102 is opened by a command from the control part 32 and the paint is supplied into the cylinder 152, as indicated by arrow (18). And then, the driving piston 106 is moved toward the driving source 97 by a driving force of the driving source 97, as indicated by arrow (19).

As a result, the paint 145 is filled between the driving piston 106 and the driven piston 107, as illustrated in FIG. 17(*b*). The primary supply valve 102 is in a closed state. The air exhaust valve 177 is opened by a command from the control part 32 and thus the compressed air 181 in the air chamber 179 is exhausted to the outside of the cylinder 152, as indicated by arrow (20). The driving source 97, the driving piston 106, the paint 145, the driven piston 107 and the cylinder 152 are moved by an urging force of the cylinder urging member 182, as indicated by arrow (21). Next, the air exhaust valve 177 is closed.

As a result, the second connection part 96 is connected to the first connection part 95 which is located in a standby state, as illustrated in FIG. 17(*c*). The first outflow control valve 135 and the second outflow control valve 143 are opened by a command from the control part 32. In this state, the driving piston 106 is extruded by a driving force of the driving source 97, as indicated by arrow (22).

In FIG. 17(*d*), the first outflow control valve 135 and the second outflow control valve 143 are closed by a command from the control part 32. As the air supply valve 175 is opened by a command from the control part 32 and thus the compressed air is supplied into the cylinder 152 as indicated by arrow (23), the driving source 97, the driving piston 106, the driven piston 107 and the cylinder 152 are moved, as indicated by arrow (24). That is, the cylinder 152 returns to a ready position before paint filling.

According to the above embodiment and a modification thereof, the paint supply system connected to an application part which moves relative to a coated object and applies paint on the coated object and supplying the paint to the application part may include a first cylinder device 16 moving together with the application part 14; 94 and supplying the paint stored therein to the application part; a second cylinder device 18; 93 temporarily storing next applied paint in a state of being disconnected from the first cylinder device 16, during application of the paint by the application part 14; 94 and connected to the first cylinder device 16 to supply the next applied paint to the first cylinder device 16, after application of the paint by the application part; and a supply valve part 20 connected to the second cylinder device 18; 93 to selectively supply paint or cleaning fluid to the second cylinder device 18; 93, at least during application of the paint by the application part 14; 94.

According to this configuration, since the paint supplied from the supply valve part 20 is stored in the second cylinder device 18 and is simply supplied from the second cylinder device 18 to the first cylinder device 16, there is no problem that it takes a long time to supply paint, as in a case of supplying the paint from a paint supply pipe provided in an inside wall of a coating room to the first cylinder device 16. Accordingly, it is possible to supply the paint from the second cylinder device 18 to the first cylinder device 16 in a short time.

In addition, the second cylinder device 18 is connected to the first cylinder device 16 and also can be disconnected from the first cylinder device 16. That is, since the second cylinder device 18 can be disconnected from the first cylinder device 16 integral with the application part 14, it is possible to supply new paint from the supply valve part 20 to the second cylinder device 18 simply by disconnecting the second cylinder device from the first cylinder device 16 in a state where the paint is supplied to the first cylinder device 16. In this way, there is no need for a paint cartridge and therefore it is not necessary to prepare a large paint supply system such as a cartridge exchange device. Accordingly, a space to be occupied by the paint supply system 10 in a factory is reduced. That is, it is possible to realize a space-saving of the paint supply system 10.

Further, since paint can be supplied to the first cylinder device 16 using the extrusion force of paint by the second cylinder device 18 and the retraction force of paint by the first cylinder device 16 when the second cylinder device 18 is connected to the first cylinder device 16, it is possible to smoothly supply paint to the main cylinder 16 with high rate, as compared to a configuration that paint is supplied to the first cylinder device 16 by a pumping power from the supply pipe.

Since the first cylinder device 16 can be disconnected from the second cylinder device 18 during application of paint by the application part 14, it is possible to easily arrange the second cylinder device 18 and the supply valve part 20 in a desire position, depending on the installation position of a device (coating robot 12) including the first cylinder device 16 and the application part 14. That is, since the first cylinder device 16 and the second cylinder device 18 can be freely connected to each other, the degree of freedom of layout (arrangement of the application part 14, the first cylinder device 16, the second cylinder device 18 and the supply valve part 20) in a coating room is improved. Accordingly, it is possible to shorten the length of paint supply pipe while expanding a range of coating operation by the application part 14. Thereby, an amount of residual paint remaining in the supply pipe becomes small and thus it is possible to remarkably suppress a loss (disposal) of paint.

Further, the paint supply system 10; 106 may include a cleaning part 17 connected to the first cylinder device 16 and supplying the cleaning fluid to the first cylinder device 16 after application of the paint by the application part, independently of connection path with the first cylinder device 16 and the second cylinder device 18; 93.

According to this configuration, since the cleaning part 17 for supplying the cleaning fluid to the first cylinder device 16 is provided independently of connection path with the first cylinder device 16 and the second cylinder device 18, it is possible to clean the application part 14 and the first cylinder device 16, after application of paint by the application part 14 (for example, during movement of the application part 14 or the first cylinder device 16 by the coating robot 12). Accordingly, cleaning time can be shortened. Further, since a short cleaning interval between the application part 14 and the first cylinder device 16 can be cleaned by the cleaning part 17, cleaning time can be further shortened and it is possible to reduce a loss of paint.

Further, a first connection part 46; 95 which is connected to the second cylinder device 18; 93 side may be connected to the first cylinder device 16. A second connection part 62; 96 which is connected to the first connection part 46; 95 may be connected to the second cylinder device 18; 93. The second connection part 62; 96 may be connected to the first connection part 46; 95 so that the next applied paint is supplied from the second cylinder device 18; 93 to the first cylinder device 16, after application of the paint by the application part 14; 94.

According to this configuration, paint can be supplied from the second cylinder device 18 to the first cylinder device 16 by connection of the first connection part 46 and the second connection part 62. In this case, it is possible to arrange the first connection part 42 at a position spaced apart from the first cylinder device 16 and to arrange the second connection part 62 at a position spaced apart from the second cylinder device 18. Further, the second cylinder device 18 can be arranged at a position which does not interfere with the movement of the coating robot 12. Accordingly, it is possible to smoothly perform application or supply of paint.

The supply valve part 20 may include a third connection part 82 which is connected to the second connection part 62. The second connection part 62 may be placed to advance and retract relative to the third connection part 82. The second connection part 62 may advance to be connected to the third connection part 82 so that the paint or the cleaning fluid is supplied from the supply valve part 20 to the second cylinder device 18, during application of the paint by the application part 14.

According to this configuration, since the second connection part 62 advances to be connected to the third connection part 82 during application of paint by the application part 14, it is possible to easily supply paint or cleaning fluid from the supply valve part 20 to the second the cylinder device 18. Further, since the actuator 64 having a simple configuration can be used as a device for advancing/retracting the second connection part 62, it is possible to reduce an installation cost.

The first cylinder device 16 and the application part 14; 94 may be disposed in plural. The first connection part 46; 95 for supplying paint to another application part 14, 94 may be connected to the second connection part 62; 96 so that the paint is supplied from the second cylinder device 18; 93 to the first cylinder device 16, during application of the paint by at least one application part 14; 94.

According to this configuration, it is possible to effectively supply paint to each first cylinder device 16 by one second cylinder device 18 even if the first cylinder device 16 and the application part 14 are provided in plural. Thereby, since a plurality of application parts 14 can apply paint on a coated object W, it is possible to further shorten the time of a coating operation.

When first applied paint and next applied paint of the application part 14; 94 are different from each other, the cleaning fluid may be supplied from the cleaning part 17 to clean the first cylinder device 16, after application of the paint by the application part 14; 94, the cleaning fluid may be supplied from the supply valve part 20 to clean the second cylinder device 18; 93, during application of the paint by the application part 14; 94 and then, the next applied paint may be supplied.

According to this configuration, since the first cylinder device 16 and the second cylinder device 18 can be separately cleaned in a shifted timing, it is possible to further shorten the cleaning time of each device. As a result, it is possible to significantly shorten the time of a cleaning operation. Thereby, it is possible to improve the efficiency of the entire coating operation.

The second cylinder device 93 may include a cylinder 105 extending in a cylindrical shape, a driving piston 106 movably provided in the cylinder 105 and connected to a driving source 97 which is attached to the cylinder 105, a driven piston 107 contacting the driving piston 106 to be freely spaced apart therefrom and movably provided in the cylinder 105, the second connection part 96 provided on a side of the driven piston 107 opposite to the driving source 97 and separably connected to the first connection part 95, a supply valve 102 connected to a through passage 108 formed in the driven piston 107 and the supply valve part 20 to fill the paint between the driving piston 106 and the driven piston 107 and, the driving source 97 for pushing back the driving piston 106. After the paint is filled between the driving piston 106 and the driven piston 107, the driving piston 106 may be pushed by the driving source 97 and the pushing force of the driving piston 106 may be transmitted to the driven piston 107 via the filled paint, so that the driven piston 107 and the second connection part 96 advance and the second connection part 96 is connected to the first connection part 95 and then the filled paint is supplied from the second connection part 96 to the first connection part 95 by pushing the driving piston 106 by the driving source 97.

According to this configuration, since the movement of the second connection part 96 and the extrusion of the paint 145 can be performed by one driving source, the number of the driving source is reduced, as compared to a case where the second connection part 96 is moved by one driving source and the paint 145 is extruded by one driving source. Accordingly, it is possible to reduce a cost of the paint supply system.

Further, according to the above embodiment and a modification thereof, the paint supply method for supplying paint to an application part which moves relative to a coated object and applies the paint on the coated object, may include an application process for supplying the paint from a first cylinder device 16 moving together with the application part 14; 94 to the application part 14; 94 and applying the paint from the application part 14; 94 to the coated object, a primary supply process for supplying next applied paint from a supply valve part 20 to the second cylinder device 18; 93 in a state of where the first cylinder device 16 and the second cylinder device 18; 93 are disconnected from each other, during the application process, a connection process for connecting the first cylinder device 16 and the second cylinder device 18; 93 to each other and, a secondary supply process for supplying the next applied paint from the second cylinder device 18; 93 to the first cylinder device 16.

According to this method, since the primary supply process for supplying next applied paint from the supply valve part 20 to the second cylinder device 18 is carried out during the application process, it is possible to smoothly supply the paint from the second cylinder device 18 filled with paint to the first cylinder device 16 in a short time.

The paint supply method may include an application side cleaning process for supplying cleaning fluid from a cleaning part 17 to the first cylinder device 16 from the primary supply process to the connection process. The cleaning part 17 is connected to the first cylinder device 16, independently of connection path with the first cylinder device 16 and the second cylinder device 18; 93.

According to this method, since a short cleaning interval between the application part 14 and the first cylinder device 16 can be cleaned by the cleaning part 17 in the application side cleaning process, cleaning time can be further shortened and it is possible to reduce a loss of paint.

The connection process may include a paint filling process for filling paint between a driving piston 106 and a driven piston 107 of the second cylinder device 93, a second connection part advancing process for advancing a second connection part 96 included in the driven piston 107 by pushing the driving piston 106 by a driving source 97 and transmitting the pushing force from the driving piston 106 to the driven piston 107 via the filled paint and, a connection part connecting process for connecting the second connection part 96 to a first connection part 95 connected to the first cylinder device 16 by continuously pushing the driving piston 106 by the driving source 97. In the secondary supply process, the filled paint may be extruded from the second connection part 96 by further pushing the driving piston 106 by the driving source 67.

According to this method, the second connection part 96 is connected to the first connection part 95 by pushing the driving piston 106 in the connection part connecting process. Further, paint is extruded from the second connection part 96 by further pushing the driving piston 106 in the secondary supply process. That is, two process of the connection part connecting process and the secondary supply process are performed by an advancing operation of the driving piston 106. As a result, in the present invention, the cylinder 93 is sufficient for one, as compared to a case where a cylinder for connecting the connection part is prepared and a cylinder for extruding paint is further prepared.

Third Embodiment

Figure 18:
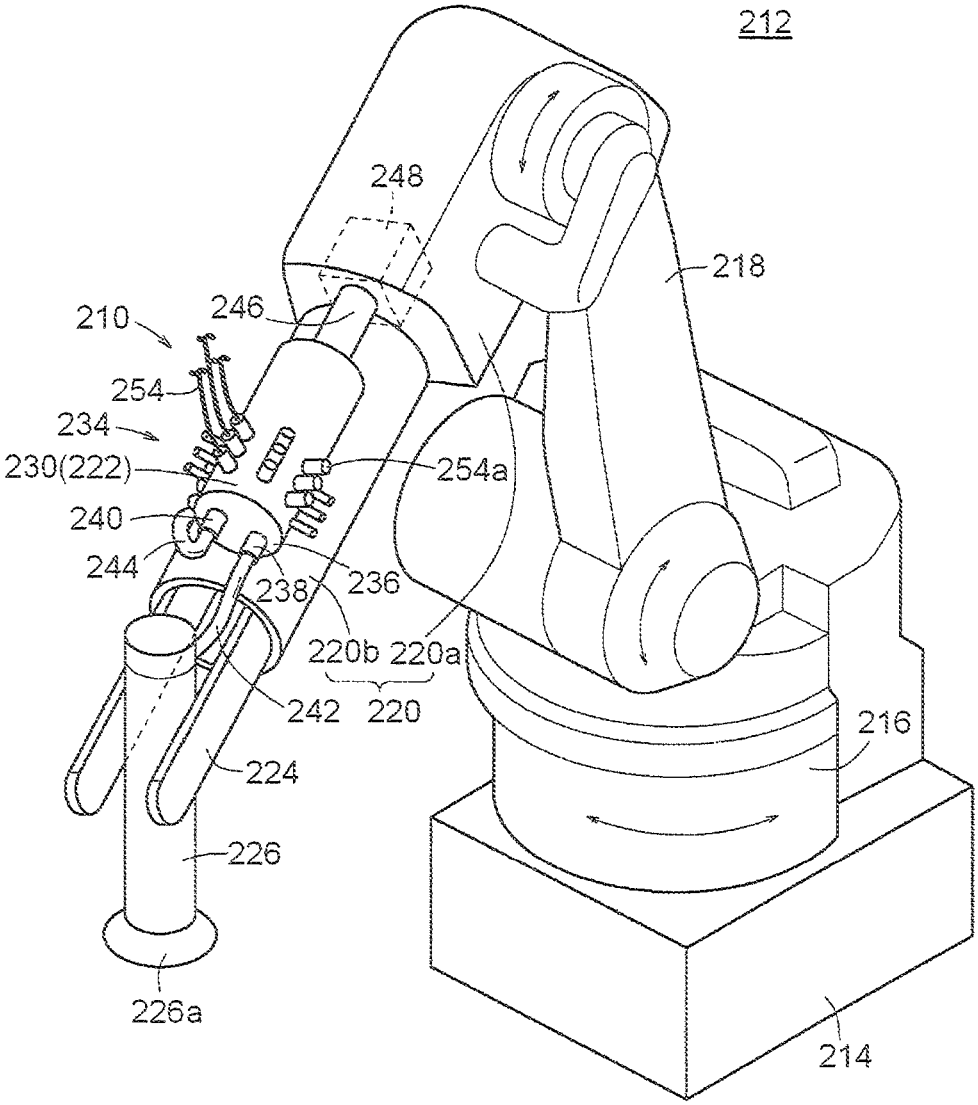
FIG. 18 is a perspective view illustrating a coating robot including a paint supply system according to a third embodiment.

FIG. 18 is a perspective view illustrating a coating robot 212 including a paint supply system 210 according to a third embodiment. The paint supply system 210 is installed in the coating robot 212 which applies paint on a work-piece (coated object) such as a body of a vehicle. Accordingly, first, the coating robot 212 will be specifically described.

The coating robot 212 is an industrial multi-articulated robot, for example. A turning part 216 of the coating robot 212 is provided on a base 214 fixed to a predetermined position in a coating room and can turn around a vertical axis. A base end of a first arm 218 is connected to an upper portion of the turning part 216 and can turn in a vertical direction. Further, a second arm 220 is connected to a leading end of the first arm 218 and can turn in a vertical direction.

The second arm 220 includes a connection part 220*a* of a base end side connected to the first arm 218 and a cylindrical extension part 220*b* provided continuously with a leading end side of the connection part 220*a* and extending in a direction of the leading end by a predetermined length. The cylinder device 222 is placed on an upper side of a side peripheral surface of the extension part 220*b*. Further, a pair of sandwiched plates 224 extends from a leading end of the extension part 220*b* and is placed to turn around an axis of the second arm 220. The coating gun 226 is supported (sandwiched) on the pair of sandwich plates 224 and can be swung with the supported point as a pivot point. The coating robot 212 is not limited to such a configuration, but various devices and mechanism can be employed to move the coating gun 226 relative to a work-piece.

As the coating gun 226, a known rotary atomizing coating device for electrostatically coating the work-piece can be suitably employed, for example. In this case, a rotary atomizing head 2263*a* is provided in a leading end of the rotary atomizing coating device (coating gun 226). When paint is applied on the work-piece, the rotary atomizing head 226*a* is rotated in a state where a high voltage is applied and thus paint is supplied to the rotary atomizing head 226*a*. Thereby, paint is negatively charged and atomized. The atomized paint can be sprayed from the leading end (the rotary atomizing head 226*a*). According to the coating gun 226, the sprayed paint is applied on the work-piece which is grounded. In this way, a good coating operation can be carried out. Of course, the coating gun 226 is not limited to the rotary atomizing coating device for electrostatically coating.

When a coating operation of the work-piece is carried out, a control part 258 (see FIG. 21) controls the actuation of a plurality of articulated portions (the turning part 216, one end of the first arm 218, one end of the second arm 220 and a pair of sandwich plates 224) of the coating robot 212 to move the coating gun 226 relative to the work-piece. In this way, the rotary atomizing head 226*a* of the coating gun 226 is placed to face a predetermined area of the work-piece. That is, the coating robot 212 positions the coating gun 226 at a coating position (a position opposing to the work-piece) of paint. In this state, a predetermined area of the work-piece is coated by spraying the paint by the application gun 226.

The cylinder device 222 mounted on a side surface of the extension part 220*b* (the second arm 220) has a function to selectively supply a plurality of kinds of paint or cleaning fluid to the coating gun 226. That is, in the paint supply system 210 according to the third embodiment, a plurality of kinds of paint including a pigment (color), a solvent, or an additive, etc., can be suitably selected as the paint and applied on the work-piece. Meanwhile, the cleaning fluid is supplied for cleaning the interior of the cylinder device 222 and the coating gun 226. In the third embodiment, two cleaning fluids of cleaning liquid and cleaning air are supplied in a predetermined timing.

Figure 19B:
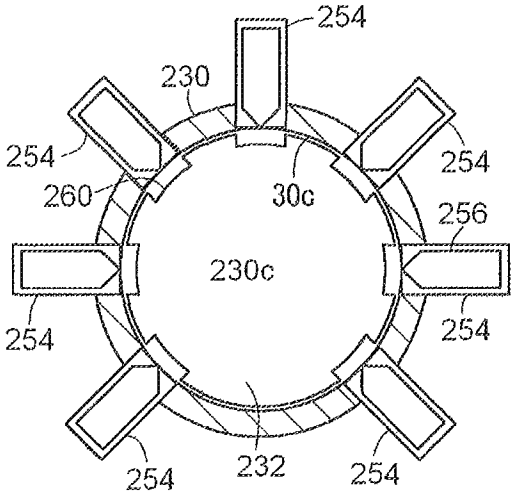
FIG. 19(*a*) is a side cross-sectional view schematically illustrating a cylinder device.
Figure 19A:
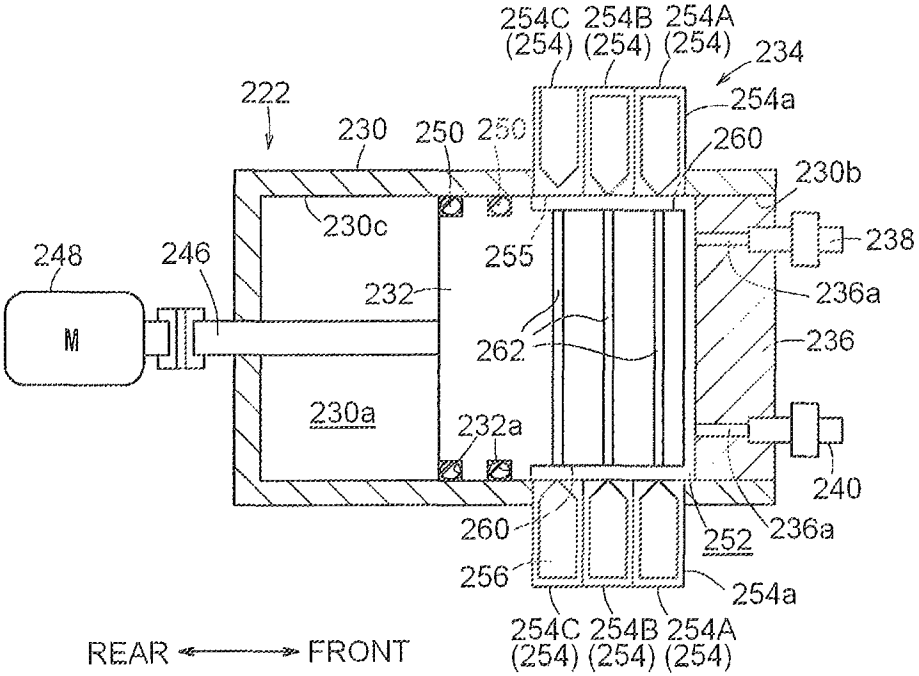

FIGS. 19(*a*) and (*b*) are views for explaining the cylinder device 222 of FIG. 18. FIG. 19(*a*) is a side cross-sectional view schematically illustrating the cylinder device and FIG. 19(*b*) is a front cross-sectional view schematically illustrating the cylinder device. In the following description, the front (leading end) and the rear (base end) of the cylinder device 222 are defined, based on the direction of arrow illustrated in FIG. 19(*a*).

As illustrated in FIG. 19(*a*), the cylinder device 222 according to the third embodiment includes a cylindrical body 230 fixedly attached to a side surface of the extension part 220*b* of the second arm 220, a piston 232 accommodated in the interior 230*a* of the cylindrical body 230 and a color change valve device (CCV: supply valve part) 234 provided continuously with the front side of the cylindrical body 230.

The cylinder device 222 includes the cylindrical body 230 in which the piston 232 is accommodated to freely slide in a front and rear direction. A lid 236 is fitted into a front opening 230*b* of the cylindrical body 230. That is, the interior 230*a* of the cylindrical body 230 is sealed by inner walls 230*c* and the lid 236.

The lid 236 is formed with two communication passages 236*a*. Two discharge terminals (the first discharge terminal 238, the second discharge terminal 240) are attached to the front side of these communication passages 236*a*. The first and second discharge terminals 238, 240 have a function to discharge paint from the interior 230*a* of the cylindrical body 230. As illustrated in FIG. 18, the first discharge terminal 238 is connected to the coating gun 226 via a supply tube 242 and the second discharge terminal 240 is connected to a paint disposal part (not-illustrated) via a discharge tube 244.

By referring to FIG. 19(*a*) again, a transmission rod 246 is inserted into a bottom of a rear side of the cylindrical body 230. The piston 232 is attached to a leading end of the transmission rod 246. A drive motor 248 is provided on a rear end of the transmission rod 246 extending outwardly from the cylindrical body 230.

The piston 232 is formed in an outer diameter which can be engaged with an inner wall 230*c* (inner diameter) of the cylindrical body 230. The inner wall has a side peripheral surface constituting the interior 230*a*. Two concave parts 232*a* are circumferentially formed on a rear side of the piston 232. An O-ring 250 is respectively seated on two concave parts 232*a*. The O-ring 250 contacts the inner wall 230*c* of the cylindrical body 230 in a state where the piston 232 is accommodated in the interior 230*a*. In this way, the piston 232 can slide in a liquid-tight manner.

The interior 230*a* of the cylindrical body 230 is formed with a reservoir 252 into which the paint is introduced. The reservoir 252 is formed by the inner wall 230*c*, a rear surface of the lid 236 and the front side of the piston 232. In this case, the volume of the reservoir 252 is variable in accordance with the sliding movement of the piston 232 in a front and rear direction.

Figure 21:
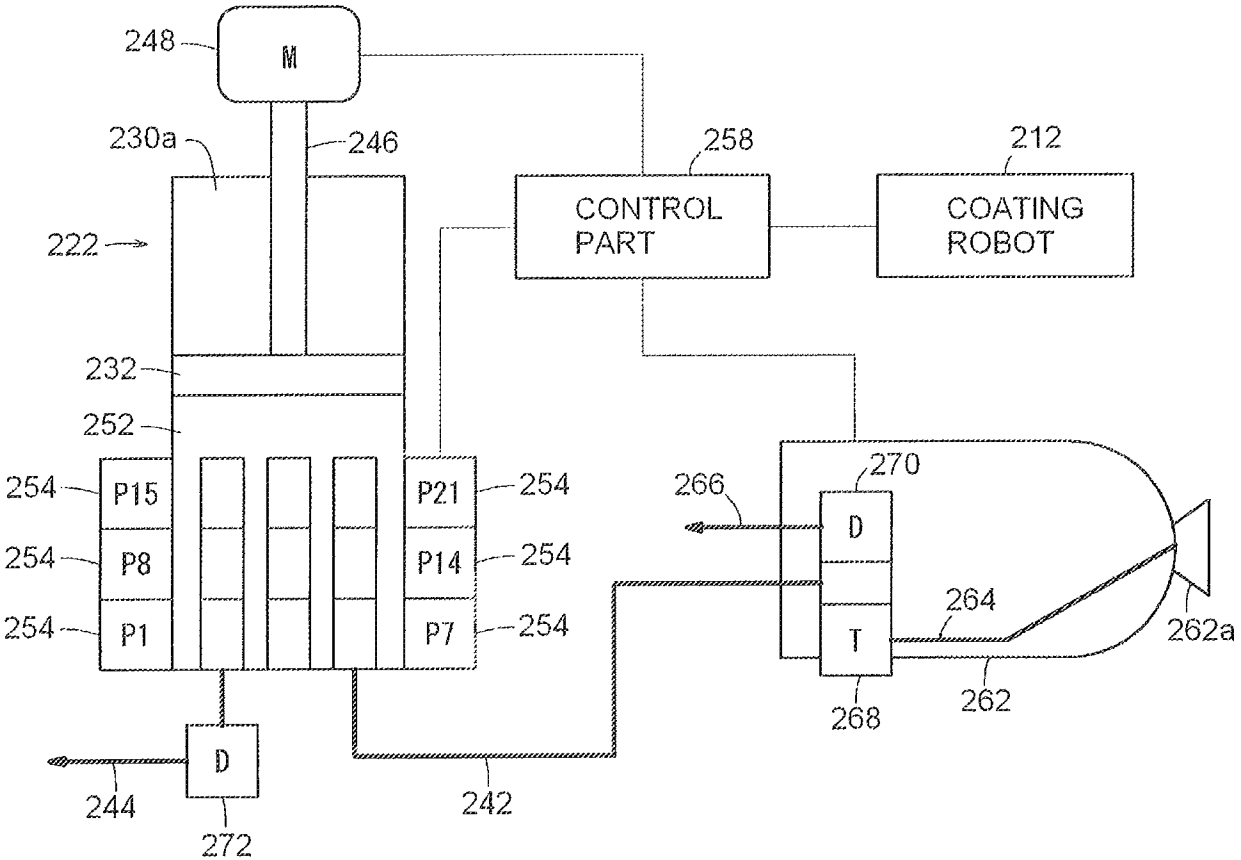
FIG. 21 is a block diagram illustrating a connection relationship of valves of a paint supply system.

Further, the drive motor 248 includes an internal mechanism (not-illustrated) which converts a rotational driving force of the motor (not-illustrated) into a linear motion in an advance-and-retract direction. The drive motor 248 is connected to the control part 258 (see; FIG. 21) to move the transmission rod 246 in a front and rear direction and to advance/retract the piston 232 attached to a leading end thereof. The drive motor 248 is not particularly limited. For example, a servo motor capable of moving the piston 232 with high-precision may be utilized. Of course, as a driving source other than the drive motor 248, an air cylinder or a linear actuator may be utilized.

As illustrated in FIG. 18, the CCV 234 of the cylinder device 222 includes a plurality of supply lines 254 for supplying a plurality of kinds of paint and cleaning fluid (cleaning liquid and cleaning air). The plurality of supply lines 254 have ends 254*a* provided continuously with a side surface of the cylindrical body 230. As illustrated in FIG. 19(*a*), openings 255 of the ends 254*a* are exposed to the inner wall 230*c* of the cylindrical body 230. That is, the cylinder device 222 according to the third embodiment has a function as a manifold into which a plurality of kinds of paint and cleaning fluid (cleaning liquid and cleaning air) are introduced from the plurality of supply lines 254, in addition to a function as a cylinder for storing and discharging paint to and from the reservoir 252 of the cylindrical body 230.

The side peripheral surface of the cylindrical body 230 is provided with three supply lines 254 formed side by side in an axial direction and seven supply lines 254 formed side by side in a circumferential direction. That is, a total of twenty-one supply lines are connected. Of course, the number of the supply line is not limited to such a value. A plurality of kinds of paint and cleaning fluid can be supplied to the reservoir 252 of the cylinder device 222 by the plurality of supply lines 254. In this case, one kind of paint (or cleaning fluid) may be supplied to the reservoir 252 by one supply line 254 or may be supplied to reservoir 252 by a plurality of supply lines 254.

A supply valve 256 for opening/closing communication of the supply line 254 is respectively provided in the vicinity (connection region with the cylindrical body 230) of the opening 255 of the supply line 254. In FIG. 19(*a*), the supply line 254 (the end 254*a*) is represented as a rectangular shape and the supply valve 256 is schematically illustrated as a wedge-shaped tip within the supply line 254. Further, in FIG. 19(*a*), the supply lines 254 are arranged in three rows from the front of the cylindrical body 230 to the rear and symbol A, B, C is given to each row of the supply line.

In the CCV 234, when desired paint or cleaning fluid is selected out of a plurality of paint and cleaning fluid by the control part 258 (see, FIG. 21) or an operator, the supply valve 256 in the supply line 254 for supplying the desired paint (or cleaning fluid) is opened to communicate the supply line 254 and the reservoir 252. Thereby, the selected paint (or cleaning fluid) can be supplied from the supply line 254 to the reservoir 252.

When supplying paint (or cleaning fluid) to the reservoir 252, the supply valve 256 is opened and the piston 232 is retracted by the drive motor 248. Thereby, the volume of the reservoir 252 which is in a liquid-tight state by the piston 232 is varied and paint (or cleaning fluid) can be drawn from the supply line 254 by a suction force due to the volume variation.

Figure 20:
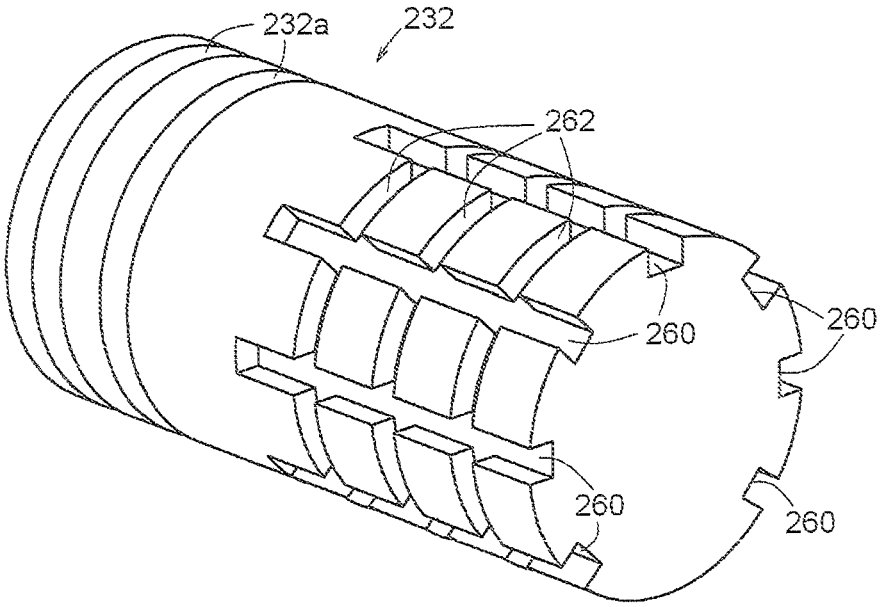
FIG. 20 is a perspective view illustrating a piston of the cylinder device.

FIG. 20 is a perspective view illustrating the piston 232 of the cylinder device 222. A plurality of grooves (first grooves 260, second grooves 262) are formed on a side peripheral surface of the piston 232 according to the third embodiment along arrangement position of the plurality of supply lines 254. Specifically, the first grooves 260 are axially formed from the middle portion of the piston 232 to the front. Seven first grooves 260 are provided on the side peripheral surface of the piston 232 to correspond to seven supply lines 254 which are arranged in a circumferential direction of the cylindrical body 230. Further, the second grooves 262 are circumferentially formed to intersect the first grooves 260. Three second grooves 262 are provided on a peripheral surface of the piston 232 to correspond to three supply lines 254 which are arranged in an axial direction of the cylindrical body 230.

The first grooves 260 have a function to communicate three rearmost supply lines 254C (see, FIG. 19(*a*)) which are formed side by side in an axial direction and the reservoir 252 to each other. That is, all openings 255 of the supply lines 254A to 254C arranged side by side in an axial direction are in communication with the reservoir 252 by the piston 232 having the first grooves 260.

Herein, for example, when a piston without the first grooves 260 is used, just a slight clearance is formed between the side peripheral surface of the piston and the inner wall 230*c* of the cylindrical body 230. For this reason, even if the piston is retracted, the inflow of paint from the supply line 254C to the reservoir 252 is hindered by the side peripheral surface of the piston and therefore there is a possibility to decrease the amount of inflow. In this case, there is a risk that impurity (air, etc.) other than paint enters the reservoir 252 by a suction force due to the volume variation of the reservoir 252.

Further, it may be considered that a plurality of supply lines 254 are connected in a circumferential direction, for example, relative to a position of the supply line 254A of FIG. 19(*a*), instead of arranging a plurality of supply lines 254 in an axial direction. However, in this case, increase in size of the cylindrical body 230 is caused. As a result, it is difficult to arrange the cylinder device 222 in the coating robot 212. Further, a drive control (positioning of coating gun 226) of the coating robot 212 is adversely affected, even if the cylinder device is arranged in the coating gun.

In contrast, since the first grooves 260 are formed in such a way that the supply line 254C connected to a rear side of the cylindrical body 230 and the reservoir 252 are communicated with each other in the cylinder device 222 according to the third embodiment, all supply lines 254 including the supply lines 254A, 254B are in communication with the reservoir 252. Accordingly, it is possible to smoothly supply paint or cleaning fluid from all supply lines 254 to the reservoir 252 through the first grooves 260 and thus it is possible to prevent impurity (air, etc.) other than paint from entering the reservoir 252.

Further, the second grooves 262 are provided perpendicular to the first grooves 260 and communicates the first grooves 260 to each other in a circumferential direction of the piston 232. For example, paint which is introduced from the supply line 254C connected to an upper side of the cylindrical body 230 in FIG. 19(*a*), for example, is also guided to an opposite side (lower side) of the piston 232 through the second grooves 262. Thereby, paint can be introduced from all of the first grooves 260 and the second grooves 262 to the reservoir 252, even though paint or cleaning fluid is introduced from any supply line 254 out of twenty-one supply lines 254 provided continuously with the cylindrical body 230. That is, since the piston 232 includes the first grooves 260 and the second grooves 262, it is possible to smoothly guide paint to the reservoir 252.

Next, a supply path of the paint and cleaning fluid in the paint supply system 210 according to the third embodiment will be described. FIG. 21 is a block diagram illustrating a connection relationship of valves of the paint supply system 210 of FIG. 18.

The paint supply system 210 includes a control part 258 which is connected to the coating robot 212, the cylinder device 222 and the coating gun 226. The control part 258 has a function to control driving of each component. That is, the control part 258 controls turning of the articulated portions (the turning part 216, the base end of the first arm 218, the base end of the second arm 220 and a pair of sandwich plates 2247) of the coating robot 212. Further, the control part 258 controls driving of the drive motor 248 while controlling opening/closing operation the supply valve 256 of the cylinder device 222. And, the control part 258 controls an operation (an operation such as rotating of the rotary atomizing head 226*a* or applying of high voltage) of the coating gun 226.

Further, the cylinder device 222 and the coating gun 222 are connected to each other by a supply tube 242. Paint or cleaning fluid is supplied from the cylinder device 222 to the coating gun 226.

A flow passage 264 and a discharge passage 266 are provided in the interior of the coating gun 226. The flow passage 264 is connected to the supply tube 242 to allow paint to flow toward a leading end (rotary atomizing head 226*a*) of the coating gun. The discharge passage 266 is connected to the flow passage 264 and communicated with a disposal part (not-illustrated). A trigger valve 268 is provided on a portion (an end of the flow passage 264) between the supply tube 242 and the flow passage 264. The trigger valve 268 opens/closes the communication of the supply tube 242 and the flow passage 264 by ON/OFF signal from the control part 258. That is, the coating gun 226 sprays the paint-supplied from the cylinder device 222 through a tip thereof by the communication of the supply tube 242 and the flow passage 264.

Further, a first dump valve 270 is disposed between the flow passage 264 and the discharge passage 266 in the coating gun 226. The first dump valve 270 opens/closes the communication of the flow passage 264 and the discharge passage 266 in the coating gun 226 by ON/OFF signal from the control part 258. The coating gun 226 can direct paint or cleaning liquid stored therein from the discharge passage 266 to the disposal part by the communication of the flow passage 264 and the discharge passage 266.

Meanwhile, the cylinder device 222 is so configured that twenty-one supply lines 254 (P1 to P21 portions in FIG. 21) are provided continuously with the cylindrical body 230, as mentioned above. These pluralities of supply lines 254 are respectively connected to a paint tank, a cleaning liquid tank and an air bombe (all of them are not-illustrated). In this case, the supply valve 256 provided on each supply line 254 (end 254*a*) is normally closed and can be selectively opened by ON signal from the control part 258. Thereby, the selected paint (cleaning fluid) can be supplied from the opened supply line 254 to the reservoir 252 of the cylinder device 222.

Further, a second dump valve 272 is housed in the second discharge terminal 240 attached to the lid 236 of the cylinder device 222. The second dump valve 272 is connected to the discharge tube 244 and is opened/closed by ON/OFF signal of the control part 258. In this way, inflow in the cylinder device 222 can be discharged to an external disposal part.

Figure 22:
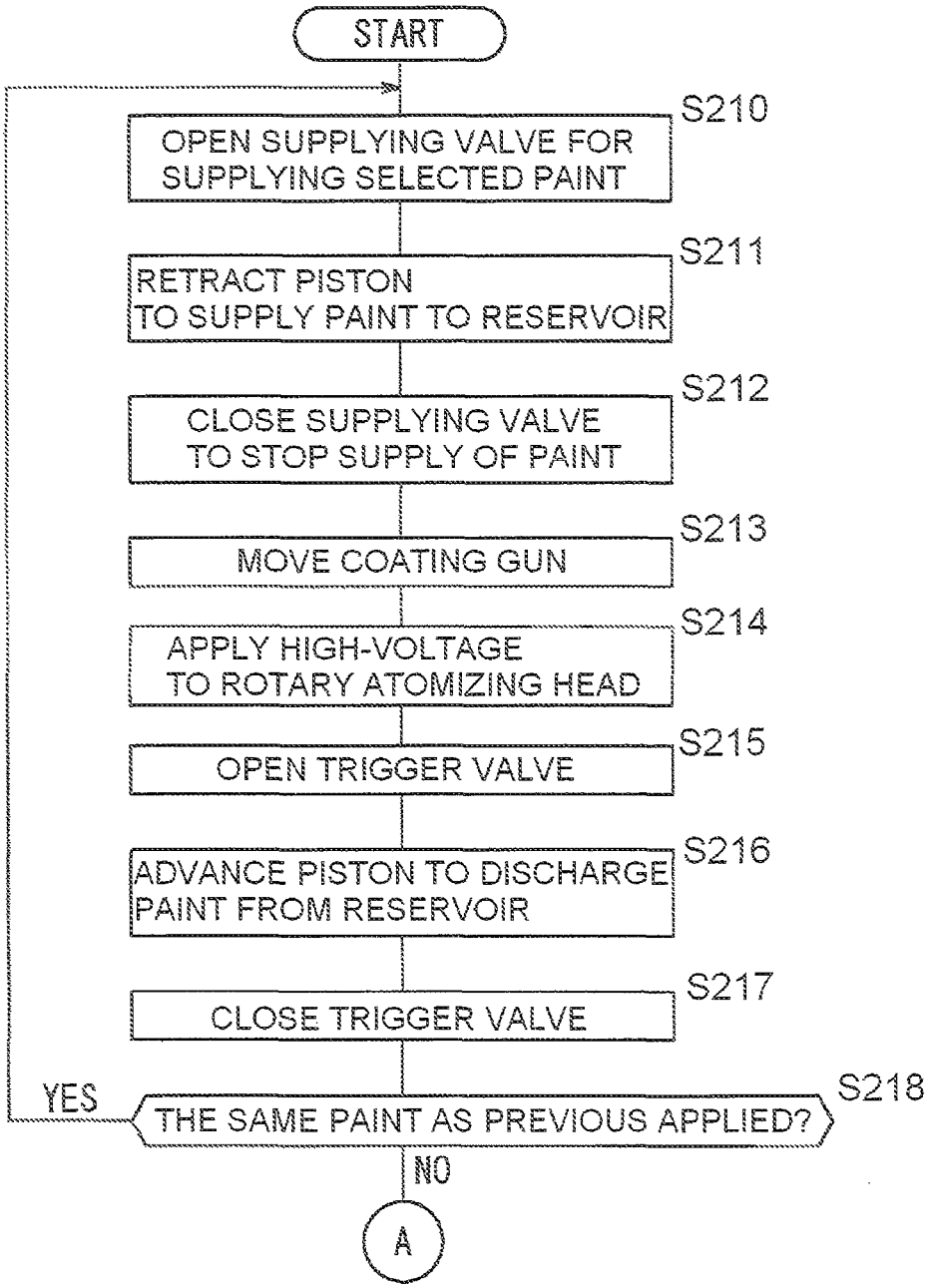
FIG. 22 is a flowchart illustrating an operation flow when coating is performed by a paint supply system.
Figure 23:
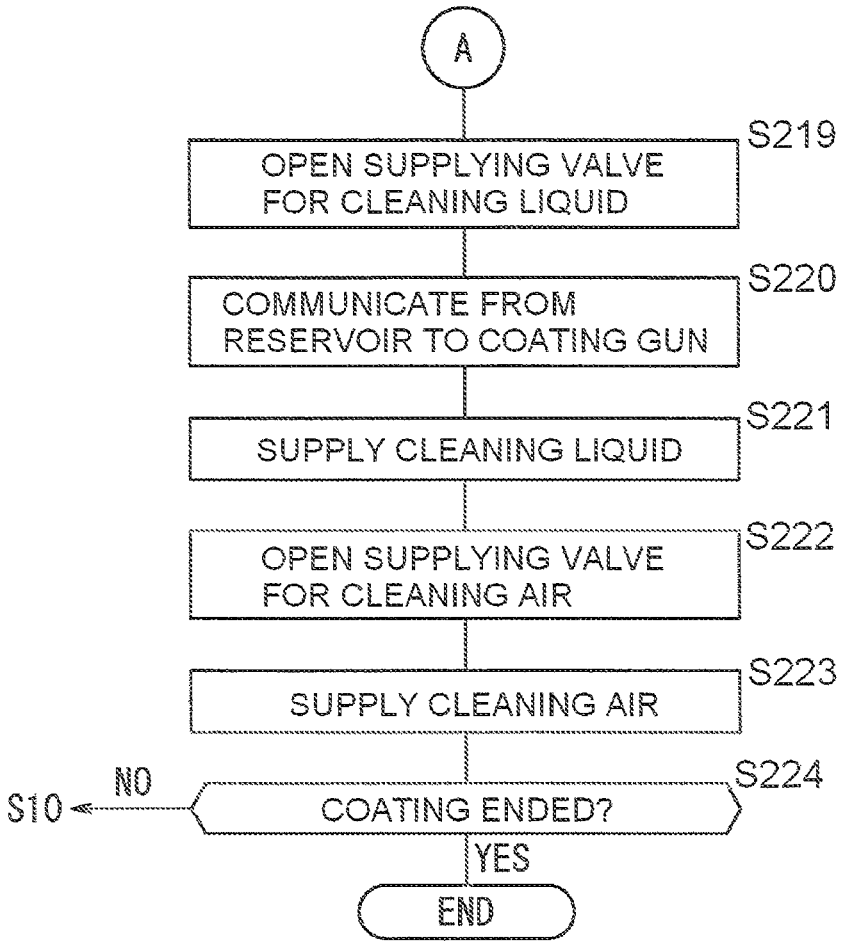
FIG. 23 is a flowchart illustrating an operation flow when cleaning is performed by a paint supply system.

FIG. 22 is a flowchart illustrating an operation flow when coating is performed by the paint supply system 210 of FIG. 21. FIG. 23 is a flowchart illustrating an operation flow when cleaning is performed by the paint supply system 210 of FIG. 21.

As illustrated in FIGS. 18 to 22, the paint supply system 210 is so configured that paint is selected by an operator or the control part 258 depending on the work-piece to be coated when supplying paint to the coating gun 226. In this case, the control part 258 opens the supply valve 256 of the supply line 254 for supplying the selected paint to supply the paint into the reservoir 252 of the cylinder device 222 (STEP S210: selection step).

And, after the selected supply valve 256 is opened (or simultaneously with opening), driving of the drive motor 248 is controlled to retract the piston 232 (STEP S211: supply step). With this retraction of the piston 232, the selected paint is introduced from the supply line 254 to the reservoir 252 by supplying the paint to the reservoir 252 by a pumping power (circulation pressure) from the supply line 254.

In this case, the paint is smoothly supplied from the supply line 254 to the reservoir 252 by the first grooves 260 and the second grooves 262 on an outer peripheral surface of the piston 232. Accordingly, it is possible to fill only paint in the reservoir 252 while preventing entrance of inflow such as air from the outside of the cylinder device 222 to the reservoir 252.

When the retraction of the piston 232 is ended and a predetermined amount of paint is stored in the reservoir 252, the control part 258 closes the supply valve 256 of the selected supply line 254 to stop supply of paint to the reservoir 252 (STEP S212).

Next, the control part 258 controls the driving of the coating robot 212 to move the coating gun 226 to a position facing a coating region of the work-piece (STEP S213).

Further, high-voltage is applied to the rotary atomizing head 226*a* of the coating gun 226 and the rotary atomizing head 226*a* starts to be rotated (STEP S214).

Further, the trigger valve 268 of the coating gun 226 is opened and therefore the supply tube 242 and the flow passage 264 are in communication with each other (STEP S215).

Thereafter, the driving of the drive motor 248 is controlled to move (advance/retract) the piston 232 in a direction of leading end thereof to discharge paint stored in the reservoir 252 (STEP S21: application step). The paint discharged from the cylinder device 222 is supplied from the first discharge terminal 238 to the coating gun 226 through the supply tube 242. The paint supplied to the coating gun 226 flows in the flow passage 264 by the extruding force of the piston 232 and is charged in the rotary atomizing head 226*a* at a leading end thereof to be sprayed.

And, the control part 258 closes the trigger valve 268 to stop supply of paint by the coating gun 226 when coating of the work-piece is ended or there is no paint which is supplied to the reservoir 252 (STEP S217).

And then, the control part 258 determines whether next applied paint is different from previously applied paint or not (STEP S218). When it is determined that next applied paint is identical to the previously applied paint, the process returns to STEP 210 and then same steps are repeated.

Meanwhile, when it is determined that next applied paint is different from the previously applied paint, the process proceeds to STEP S219 of FIG. 23 to perform cleaning of the cylinder device 222 and the coating gun 226. In this case, the control part 258 selects cleaning liquid, opens the supply valve 256 of the supply line 254 for supplying the cleaning liquid, and allows the cleaning liquid to flow into the reservoir 252 (STEP S219).

Further, the trigger 268 of the coating gun 226 and the first dump valve 270 are opened to communicate from the reservoir 252 to the flow passage 264 (coating gun 226) through the supply tube (STEP S220).

Thereafter, cleaning liquid is supplied to the reservoir 252 by a pumping power of cleaning liquid from the supply line 254 in which the supply valve 256 is opened (STEP S221). This cleaning liquid is mixed with paint remaining in the reservoir 252 to clean the reservoir 252. Further, the cleaning liquid supplied to the reservoir 252 is supplied to the coating gun 226 via the supply tube 242. The cleaning liquid supplied to the coating gun 226 cleans the interior of the coating gun 226 and then is discharged from the leading end (the rotary atomizing head 226*a*) and the discharge passage 266.

When the cleaning by cleaning liquid is ended, the control part 258 selects cleaning air and opens the supply valve 256 of the supply line 254 for supplying the cleaning air, and allows the cleaning air to flow into the reservoir 252 (STEP S222).

Thereafter, cleaning air is supplied to the reservoir 252 by a pumping power of cleaning air from the supply line 254 in which the supply valve 256 is opened (STEP S223). This cleaning air discharges the cleaning liquid remaining in the reservoir 252 to the outside by a flowing force thereof. That is, the cleaning air (and cleaning liquid) is supplied to the coating gun 226 via the supply tube 242. The cleaning air supplied to the coating gun 226 flows in the coating gun 226 and then is discharged from the leading end (the rotary atomizing head 226*a*) and the discharge passage 266.

Finally, a kind of paint is determined (STEP S224) and coating is ended. Coating operation is ended by performing a predetermined driving stop process by the control part 258. Meanwhile, when the coating is resumed, the process returns to STEP S210 and then the same flow is performed.

By supplying paint to the coating gun 226 in such a way, it is possible to smoothly guide the selected paint or cleaning fluid from the CCV 234 to the coating gun 226 via the reservoir 252 of the cylindrical body 230. Accordingly, it is possible to avoid a problem that air penetrates the paint to be applied by the coating gun 226.

Further, the paint supply system 210 may employ a separate process (modification) illustrated in FIG. 24 as a cleaning process (a later process than STEP S218) which is carried out during color change of paint.

Figure 24:
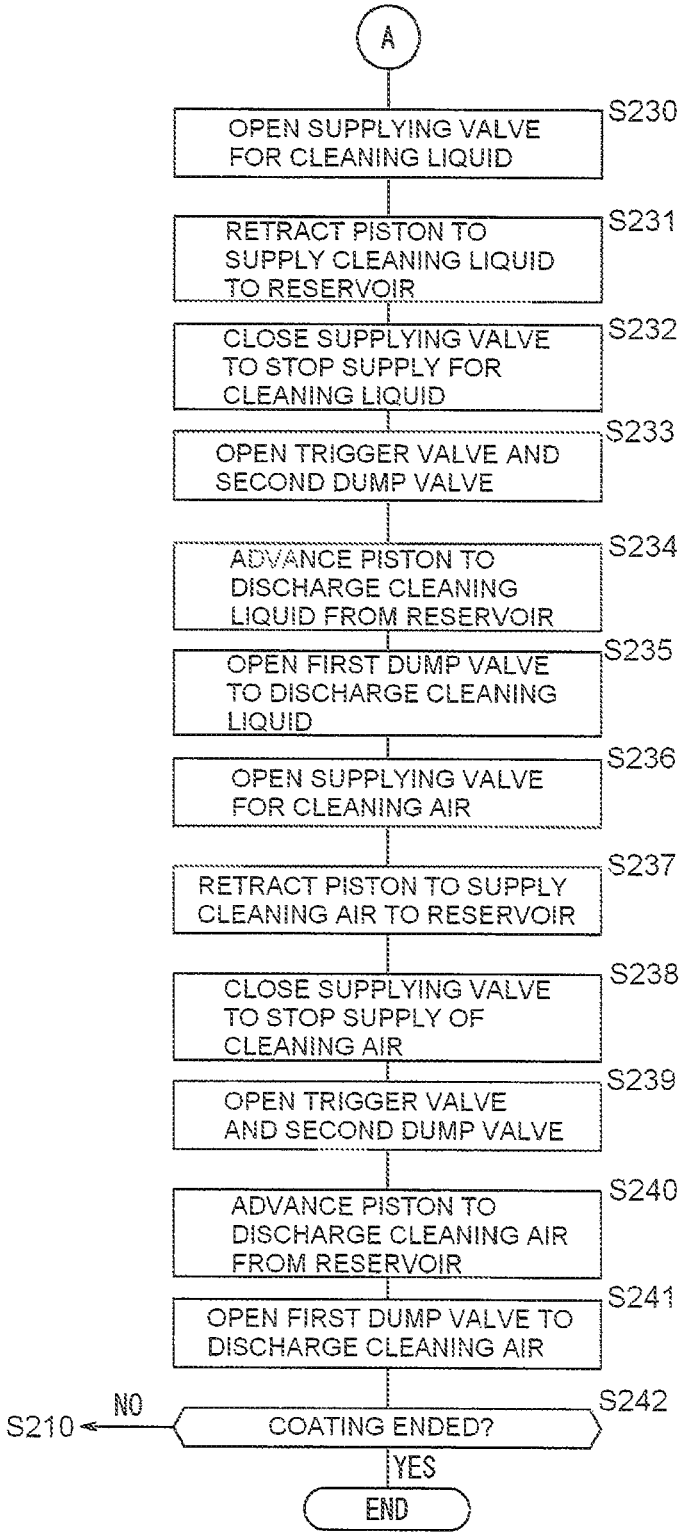
FIG. 24 is a flowchart illustrating a modification of an operation flow when cleaning is performed by a paint supply system.

In the cleaning process illustrated in FIG. 24, first, the control part 258 selects cleaning liquid, opens the supply valve 256 of the supply line 254 for supplying the cleaning liquid, and allows the cleaning liquid to flow into the reservoir 252 of the cylinder device 222 (STEP S230).

And, after the selected supply valve 256 is opened (or simultaneously with opening), driving of the drive motor 248 is controlled to retract the piston 232 (STEP S231). Cleaning liquid is supplied to the reservoir 252 by the retraction of the piston 232*a* and a pumping power of cleaning liquid from the supply line 254 in which the supply valve 256 is opened.

When the retraction of the piston 232 is ended and the cleaning liquid is supplied (stored) in the reservoir 252, the control part 258 closes the supply valve 256 of the selected supply line 254 to stop inflow of cleaning liquid to the reservoir 252 (STEP S232).

Next, the trigger valve 268 of the coating gun 226 and the second dump valve 272 are opened and therefore the supply tube 242, the flow passage 264 and the discharge tube 244 are in communication with each other (STEP S233).

Thereafter, the driving of the drive motor 248 is controlled to move (advance/retract) the piston 232 in a direction of leading end thereof to discharge cleaning liquid supplied into the reservoir 252 (STEP S234). In this case, a portion of the cleaning liquid discharged from the cylinder device 222 is supplied from the first discharge terminal 238 to the coating gun 226 through the supply tube 242. The other cleaning liquid is discharged to, the disposal part through the discharge tube 244. The cleaning liquid supplied to coating gun 226 cleans the interior of the coating gun 226.

And, when cleaning of the interior of the coating gun 226 is ended, the control part 258 opens the first dump valve 270 to discharge the cleaning liquid from the discharge passage 266 to the disposal part (STEP S235).

When the cleaning by cleaning liquid is ended, the control part 258 selects cleaning air and opens the supply valve 256 of the supply line 254 for supplying the cleaning air, and allows the cleaning air to flow into the reservoir 252 of the cylinder device (STEP S236).

And, after the selected supply valve 256 is opened (or simultaneously with opening), driving of the drive motor 248 is controlled to retract the piston 232 (STEP S237). Cleaning air is supplied to the reservoir 252 by the retraction of the piston 232*a* and a pumping power of cleaning air from the supply line 254 in which the supply valve 256 is opened.

When the retraction of the piston 232 is ended and the cleaning air is supplied in the reservoir 252, the control part 258 closes the supply valve 256 of the selected supply line 254 to stop inflow of cleaning air to the reservoir 252 (STEP S238).

Next, the trigger valve 268 of the coating gun 226 and the second dump valve 272 are opened and therefore the supply tube 242, the flow passage 264 and the discharge tube 244 are in communication with each other (STEP S239).

Thereafter, the driving of the drive motor 248 is controlled to move (advance/retract) the piston 232 in a direction of leading end thereof to discharge cleaning air supplied into the reservoir 252 (STEP S240). Thereby, the cleaning liquid remaining in the reservoir 252 can be discharged by the cleaning air. The cleaning air is supplied from the first discharge terminal 238 to the coating gun 226 through the supply tube 242 and discharged to the disposal part through the discharge tube 244.

And, the control part 258 opens the first dump valve 270 to discharge the cleaning liquid remaining in the coating gun 226 from the discharge passage 266 to the disposal part by the cleaning air (STEP S241).

Finally, a kind of paint is determined (STEP S242) and coating is ended. Coating operation is ended by performing a predetermined driving stop process by the control part 258. Meanwhile, when the coating is resumed, the process returns to STEP S210 and then the same flow is performed.

As such, when cleaning liquid and cleaning air are supplied to the reservoir 252, the cleaning liquid and cleaning air may be introduced into the reservoir by reciprocating the piston 232.

As mentioned above, since the CCV 234 capable of selectively supplying a plurality of kinds of paint and cleaning fluid to the reservoir 252 is provided continuously with the cylindrical body 230 in the paint supply system 210 according to the third embodiment, it is possible to directly supply the selected paint or cleaning fluid to the reservoir 252. In this way, since the cleaning fluid can be directly supplied to the reservoir 252 to perform cleaning during color change of paint, a paint loss can be significantly reduced, as compared to a configuration (configuration disclosed in Patent Document 3 and 4) that paint is supplied from the CCV 234 to the cylindrical body 230 via a pipe, for example. Accordingly, it is possible to reduce a coating cost.

Further, since the cylindrical body 230 is provided in the second arm 220 in the paint supply system 210 according to the third embodiment, it is possible to shorten a length between the CCV 234 and the coating gun 226. Accordingly, when application of the paint is ended, it is possible to reduce an amount of paint remaining in the CCV 234, the coating gun 226 and a communication part thereof. Consequently, a paint loss during cleaning can be further reduced.

According to the third embodiment, the paint supply system 210 connected to an application part which applies paint on a coated object and supplying paint or cleaning fluid selected from a plurality of kinds of paint and cleaning fluid to the application part, may include a cylindrical body 230 connected to the application part 226 and having the reservoir 252 capable of temporarily storing the selected paint and discharging the paint at a predetermined timing and a supply valve part 234 capable of individually supplying the plurality of kinds of paint or the cleaning fluid to the reservoir 252. The supply valve part 234 may be provided continuously with the cylindrical body 230 and directly supply the selected paint or cleaning fluid to the reservoir 252.

According to this configuration, since the supply valve part is provided continuously with the cylindrical body and the selected paint or cleaning fluid is directly supplied to the reservoir, the cleaning fluid can be directly supplied to the reservoir to perform cleaning, during the color change of paint. Further, since the cleaning fluid is discharged from the reservoir, it is possible to easily supply the cleaning fluid to the application part. That is, since a pipe between the supply valve part and the cylindrical body can be omitted by providing the supply valve part continuously with the cylindrical body, a paint loss can be significantly reduced, as compared to a conventional configuration that the paint is supplied through a pipe connecting the supply valve part and the cylindrical body. Accordingly, it is possible to reduce a coating cost.

A piston 232 capable of sliding in the reservoir 252 may be provided in the cylindrical body 230. As the piston 232 moves in one direction, the selected paint may flow from the supply valve part 234 to the reservoir 252. As the piston moves in the other direction, the selected paint may be discharged from the reservoir 252.

According to this configuration, when the piston moves in one direction, only the selected paint can be desirably supplied to the reservoir while preventing air from penetrating the reservoir though a part (for example, application part) other than the supply line. Further, when the piston moves in the other direction, the paint introduced into the reservoir can be smoothly discharged.

The supply valve part 234 may include a plurality of supply lines 254 capable of individually supplying the plurality of kinds of paint or cleaning fluid to the reservoir 252. The plurality of supply lines 254 may be connected to a side of the cylindrical body 230 side by side in an axial direction. The piston 232 may include first grooves 260 which are axially formed along an arrangement position of the plurality of supply lines 254.

According to this configuration, since the plurality of supply lines are connected to a side of the cylindrical body side by side in an axial direction and the piston includes first grooves which are axially formed along an arrangement position of the plurality of supply lines, it is possible to easily communicate the supply line and the reservoir which are axially connected to each other. In this way, the paint or the cleaning fluid supplied from the plurality of supply lines can be smoothly supplied to the reservoir. Accordingly, it is possible to securely prevent air from penetrating the reservoir though a part (for example, application part) other than the supply line.

The plurality of supply lines 254 may be connected to a side of the cylindrical body 230 side by side in a circumferential direction. The piston 232 may include second grooves 262 which are circumferentially formed along an arrangement position of the plurality of supply lines.

According to this configuration, since the plurality of supply lines are connected to a side of the cylindrical body side by side in a circumferential direction and the piston includes second grooves which are circumferentially formed along an arrangement position of the plurality of supply lines, the paint supplied from the selected supply line can pass through the second grooves and therefore be easily guided to an opposite side of the piston. Thereby, it is possible to smoothly flow the paint or cleaning fluid into the reservoir.

The cylindrical body 230 may be disposed in the vicinity of the application part 226.

According to this configuration, since the cylindrical body is disposed in the vicinity of the application part, it is possible to shorten a distance between the supply valve part and the application part. Accordingly, when application of the paint is ended, it is possible to reduce an amount of paint remaining in the supply valve part, the application part and a communication part thereof. Consequently, a paint loss during cleaning can be further reduced.

Further, according to the third embodiment, the paint supply method for supplying paint or cleaning fluid selected from a plurality of kinds of paint and cleaning fluid to an application part which applies paint on a coated object, may include a selection step for selecting paint or cleaning fluid to be supplied to the reservoir 252 of a cylindrical body 230 out of the plurality of kinds of paint and the cleaning fluid by a supply valve part 234 which is provided continuously with the cylindrical body 230, a supply step for supplying the paint or the cleaning fluid selected in the selection step to the reservoir 252 and, an application step for applying the paint in such a way to discharge the paint stored in the reservoir 252 in the supply step and supply the paint to the application part 226.

According to this paint supply method, since the selection step, the supply step and the application step are included, it is possible to smoothly guide the selected paint or cleaning fluid from the supply valve part to the application part via the reservoir of the cylindrical body. Accordingly, it is possible to avoid a problem that air penetrates the paint to be applied by the application part. Further, since the selected paint or cleaning fluid can be directly supplied to the reservoir by the supply valve part which is provided continuously with the cylindrical body, a paint loss can be significantly reduced.

According to the structure and method of the third embodiment, when cleaning is performed during the color change of paint, a paint loss can be significantly reduced. Accordingly, it is possible to reduce a coating cost.

The present invention is not limited to the above embodiments, but may have various configurations and process without departing from the gist of the invention.

What is claimed is:

1. A paint supply system connected to an application part which moves relative to a coated object and applies paint on the coated object and supplying the paint to the application part, the paint supply system comprising:

a first cylinder device moving together with the application part, adapted to supply the paint stored therein to the application part, and arranged in the vicinity of the application part;

a second cylinder device adapted to temporarily store next applied paint in a state of being disconnected from the first cylinder device during an application of the paint by the application part, and to supply the next applied paint to the first cylinder device in a state of being connected to the first cylinder device after the application of the paint by the application part;

a supply valve part connected to the second cylinder device, at least during the application of the paint by the application part, to selectively supply paint and cleaning fluid to the second cylinder device;

a first connection part which is connected to the first cylinder device and which is movable together with the application part; and a second connection part which is connected to the second cylinder device, and is adapted to be connected to the first connection part, the second connection part being movable in a vertical direction by a second actuator, wherein the first cylinder device and the first connection part are movable via a first actuator, wherein when the application of the paint by the application part is being performed, the second connection part is disconnected from the first connection part by moving the second connection part upward in the vertical direction by the second actuator, and wherein when the next applied paint is supplied from the second cylinder device to the first cylinder device after the application of the paint by the application part, the first connection part is moved by the first actuator to a predetermined position that is downward of the second connection part and upward of the supply valve part in the vertical direction, and the second connection part is connected to the first connection part bar moving the second connection part downward in the vertical direction by the second actuator.

2. The paint supply system according to claim 1 further comprising:

a cleaning part which is provided independently of a connection path between the first cylinder device and the second cylinder device and connected to the first cylinder device after the application of the paint by the application part to supply the cleaning fluid to the first cylinder device.

3. The paint supply system according to claim 1, wherein the supply valve part includes a third connection part which is adapted to be connected to the second connection part, the third connection part placed in a position that is disposed downward from the second connection part in the vertical direction, wherein the second connection part is arranged to advance and retract in the vertical direction relative to the third connection part and to be connected to the third connection part when the second connection part is advanced to the third connection part by moving the second connection part downward by the actuator, wherein when the second connection part is connected to the third connection part, the paint or the cleaning fluid is supplied from the supply valve part to the second cylinder device during the application of the paint by the application part, and wherein the second connection part is disconnected from the third connection part by moving the second connection part upward by the actuator.

4. The paint supply system according to claim 1, wherein the first cylinder device and the application part are disposed in plural, each of a plurality of the first cylinder devices corresponds to each of a plurality of the application parts, and wherein, during an application of the paint by at least one application part, the paint is supplied from the second cylinder device to another first cylinder device that corresponds to another application part.

5. The paint supply system according to claim 2, wherein, when first applied paint and next applied paint of the application part are different from each other, the cleaning fluid is supplied from the cleaning part to clean the first cylinder device, after the application of the paint by the application part, the cleaning fluid is supplied from the supply valve part to clean the second cylinder device, during the application of the paint by the application part, and then the next applied paint is supplied.

6. The paint supply system according to claim 1, wherein the second cylinder device includes:

a cylinder extending in a cylindrical shape;

a driving piston provided movably in the cylinder and connected to a driving source which is attached to the cylinder;

a driven piston provided movably in the cylinder and arranged to be movable between a first position which is contacting the driving piston and a second position which is separated from the driving piston;

the second connection part provided on a side of the driven piston opposite to the driving source and separably adapted to be connected to the first connection part;

a supplying valve connected to a through passage formed in the driven piston and the supply valve part to fill the paint between the driving piston and the driven piston; and the driving source adapted to push back the driving piston, wherein, after the paint is filled between the driving piston and the driven piston, the driving piston is pushed by the driving source and the pushing force of the driving piston is transmitted to the driven piston via the filled paint, so that the driven piston and the second connection part advance, the second connection part is connected to the first connection part, and then the filled paint is supplied from the second connection part to the first connection part by pushing the driving piston by the driving source.

7. The paint supply system according to claim 1, wherein the paint supply system supplies paint or cleaning fluid selected from a plurality of kinds of paint and cleaning fluid to the application part, and wherein the supply valve part is provided continuously with the second cylinder device as part of the second cylinder device and is adapted to directly supply paint or cleaning fluid to the second cylinder device.

8. The paint supply system according to claim 7, wherein a piston capable of sliding is provided in the second cylinder device, and wherein the system is adapted such that the selected paint flows from the supply valve part to the second cylinder device as the piston moves in one direction, and the selected paint is discharged from the second cylinder device as the piston moves in the other direction.

9. The paint supply system according to claim 8, wherein the supply valve part includes a plurality of supply lines capable of individually supplying the plurality of kinds of paint or cleaning fluid to the second cylinder device, wherein the plurality of supply lines are connected to a side of the second cylinder device side by side in an axial direction, and wherein the piston includes first grooves which are axially formed along positions of the plurality of supply lines.

10. The paint supply system according to claim 9, wherein the plurality of supply lines are connected to a side of the second cylinder device side by side in a circumferential direction, and wherein the piston includes second grooves which are circumferentially formed along positions of the plurality of supply lines.

11. The paint supply system according to claim 7, wherein the second cylinder device is disposed in the vicinity of the application part.

* * * * *